US009857735B1

(12) United States Patent
Yamada et al.

(10) Patent No.: US 9,857,735 B1
(45) Date of Patent: Jan. 2, 2018

(54) ENDLESS BELT, IMAGE FORMING APPARATUS, AND ENDLESS BELT UNIT

(71) Applicant: FUJI XEROX CO., LTD., Tokyo (JP)

(72) Inventors: Wataru Yamada, Kanagawa (JP); Tsuyoshi Miyamoto, Kanagawa (JP); Tomoya Sasaki, Kanagawa (JP); Kana Miyazaki, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/346,180

(22) Filed: Nov. 8, 2016

(30) Foreign Application Priority Data

Jun. 15, 2016 (JP) ..... 2016-119132

(51) Int. Cl.
*G03G 15/20* (2006.01)
*G03G 15/16* (2006.01)

(52) U.S. Cl.
CPC ..... *G03G 15/162* (2013.01); *G03G 15/2057* (2013.01); *G03G 2215/1623* (2013.01); *G03G 2215/2016* (2013.01)

(58) Field of Classification Search
CPC ..... G03G 15/162; G03G 15/2057; G03G 2215/1623; G03G 2215/2016
See application file for complete search history.

(56) References Cited

U.S. PATENT DOCUMENTS

| | | | | |
|---|---|---|---|---|
| 5,621,512 | A | 4/1997 | Uehara et al. | |
| 2014/0072341 | A1* | 3/2014 | Sasaki | G03G 5/0592 399/159 |
| 2014/0072906 | A1* | 3/2014 | Iwadate | G03G 5/0514 430/56 |
| 2014/0248070 | A1 | 9/2014 | Kubo et al. | |

FOREIGN PATENT DOCUMENTS

| | | | |
|---|---|---|---|
| JP | H05-200904 | A | 8/1993 |
| JP | H06-149083 | A | 5/1994 |
| JP | H06-228335 | A | 8/1994 |
| JP | 3298354 | B2 | 7/2002 |
| JP | 2010-066430 | A | 3/2010 |
| JP | 2014-170048 | A | 9/2014 |

* cited by examiner

*Primary Examiner* — Hoang Ngo
(74) *Attorney, Agent, or Firm* — Oliff PLC

(57) ABSTRACT

An endless belt includes a polyimide resin layer in which a content of at least one solvent selected from a solvent group A consisting of a urea solvent, an alkoxy group-containing amide solvent, and an ester group-containing amide solvent is from 50 ppm to 2,000 ppm.

14 Claims, 6 Drawing Sheets

ENDLESS BELT, IMAGE FORMING APPARATUS, AND ENDLESS BELT UNIT

CROSS-REFERENCE TO RELATED APPLICATIONS

This application is based on and claims priority under 35 USC 119 from Japanese Patent Application No. 2016-119132 filed Jun. 15, 2016.

BACKGROUND

1. Technical Field

The present invention relates to an endless belt, an image forming apparatus, and an endless belt unit.

2. Related Art

An electrophotographic image forming apparatus forms a charge on a photoreceptor, forms an electrostatic charge image using a modulated image signal by means of laser light or the like, and then develops an electrostatic charge image with a charged toner to form a toner image. Next, the electrophotographic image forming apparatus transfers this toner image to a recording medium such as paper directly or via an intermediate transfer member and fixes the image to the recording medium to obtain an image.

SUMMARY

According to an aspect of the invention, there is provided an endless belt including:

a polyimide resin layer in which a content of at least one solvent selected from a solvent group A consisting of a urea solvent, an alkoxy group-containing amide solvent, and an ester group-containing amide solvent is from 50 ppm to 2,000 ppm.

BRIEF DESCRIPTION OF THE DRAWINGS

Exemplary embodiments of the present invention will be described in detail based on the following figures, wherein.

DETAILED DESCRIPTION

Figure 1:
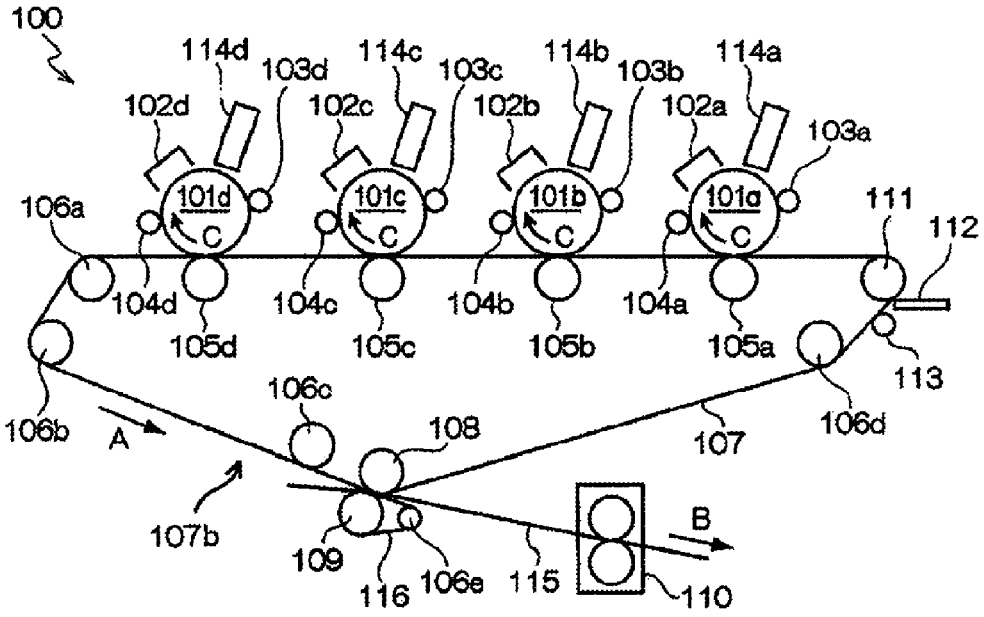
FIG. 1 is a schematic configuration diagram showing an example of an image forming apparatus according to an exemplary embodiment.

Hereinafter, the exemplary embodiments which are examples of the invention will be described in detail.

Endless Belt

An endless belt according to an exemplary embodiment has a polyimide resin layer containing at least one solvent selected from a solvent group A consisting of a urea solvent, an alkoxy group-containing amide solvent, and an ester group-containing amide solvent. The content of one or more solvents selected from the solvent group A is from 50 ppm to 2,000 ppm based on weight.

The polyimide resin is used in various fields by utilizing characteristics thereof. For example, in an electrophotographic image forming apparatus, an endless belt formed by using a polyimide resin is used.

The endless belt used in an image forming apparatus is used as an endless belt, for example, a transfer belt (including an intermediate transfer belt) of a transfer device (an example of a transfer unit), a transport belt of a device of transporting a recording medium such as paper (an example of a recording medium), or a fixing belt (for example, at least one of a heating belt and a pressure belt) of a fixing device (an example of a fixing unit).

One required characteristic of the endless belt that is used in an image forming apparatus is, for example, resistance against permanent deformation in the case in which the endless belt is in a bent state.

In recent years, in order to respond to a request for miniaturization of an image forming apparatus, a transfer device, a recording medium transport device, and a fixing device to be provided in an image forming apparatus has been also miniaturized. Therefore, as an image forming apparatus is miniaturized, a load on the bent state portion (bent portion) of the endless belt that is used in the image forming apparatus also increases.

For example, the endless belt (intermediate transfer belt, transfer belt, or transport belt) of the transfer device and the recording medium transport device is stretched in a state in which tension is applied by plural rolls. Then, in the area in which the endless belt is stretched in a state in which tension is applied by the plural rolls, the endless belt has a bent state portion.

As the image forming apparatus is miniaturized, the diameter of the roll over which the endless belt is stretched is decreased and the number of rolls is also reduced. Therefore, in a state in which tension is applied by the rolls, the stretched endless belt has a bent portion having a large curvature. As a result, when the endless belt is stored in a state in which the endless belt has a bent portion having a large curvature, permanent deformation (a state in which the shape of the bent portion is maintained) easily occurs in the bent portion of the endless belt.

On the other hand, the endless belt of the fixing device (fixing belt: at least one of a heating belt and a pressure belt) has a bent portion so as to increase a contact area between paper and the fixing belt from the viewpoint of improving fixability of a toner image to paper, a paper peeling property or the like in some cases. As the image forming apparatus is miniaturized, the curvature of the bent portion of the fixing belt increases. Therefore, when the fixing belt is stored in this state, permanent deformation easily occurs in the bent portion.

In contrast, due to the above configuration of the endless belt according to the exemplary embodiment, even in the case in which the endless belt with a bent portion is stored, permanent deformation (a state in which the shape of the bent portion is maintained) is prevented from occurring in the bent portion of the endless belt. Although the reason is not clear, it is assumed as follows.

The polyimide resin may be obtained by imidization of a polyimide precursor composition by heating. In the imidization process, a solvent in which the polyimide precursor is dissolved is volatilized. In this process, the interaction between the polar group of the polyimide precursor and the polar group of the solvent of the solvent group A occurs. In the obtained polyimide resin, it is considered that the molecular chain of the polyimide resin and the molecules of the solvent of the solvent group A form a stacking (laminated) structure. In the case in which the amount of the solvent of the solvent group A contained in the polyimide resin is too small, the interaction between the polar group of the solvent of the solvent group A and the polar group of the polyimide resin is weak. On the other hand, in the case in which the content of the solvent of the solvent group A is too large, a distance between the molecular chains of the polyimide resin increases.

Therefore, by controlling the amount of the solvent of the solvent group A in the polyimide resin to be within the above range, a stable stacking structure is formed between the molecular chain of the polyimide resin and the molecules of the solvent of the solvent group A.

Here, it is considered that the interaction between the polar group of the solvent of the solvent group A and the polar group of the polyimide resin is stronger than the interaction between polar groups of a solvent and a polyimide resin in the case in which a polyimide resin includes a solvent (such as N-methylpyrrolidone, N,N-dimethylacetamide, or γ-butyrolactone) used in the related art. Therefore, it is considered that the stacking structure that the molecular chain of the polyimide resin and the molecules of the solvent of the solvent group A form has a stabler structure compared with the case of a polyimide resin using a solvent used in the related art.

Accordingly, it is considered that in the polyimide resin including the solvent of the solvent group A, a stabler stacking structure is formed between the molecular chain of the polyimide resin and the molecules of the solvent of the solvent group A.

In addition, since the polyimide resin in which the amount of the solvent of the solvent group A is set to be within the above range has a stronger interaction with the polar group of the solvent than the interaction between polar groups of a solvent used in the related art and a polyimide resin as described above, it is considered that the flexibility of the polyimide resin is increased.

As described above, since the polyimide resin layer constituting the endless belt according to the exemplary embodiment contains the solvent of the solvent group A in the above amount range, it is considered these effects are obtained. As a result, it is considered that the endless belt according to the exemplary embodiment is capable of preventing permanent deformation from occurring in the bent portion of the endless belt after being stored.

The polar group of the solvent of the solvent group A corresponds to a urea group in the case of using a urea solvent, an alkoxy group and an amide group in the case of using an alkoxy group-containing amide solvent, and an ester group and an amide group in the case of using an ester group-containing amide solvent. In addition, the polar group in the polyimide precursor and polyimide resin corresponds to an amide group or a carboxyl group.

From the above, due to the above configuration of the endless belt according to the exemplary embodiment, it is assumed that even in the case in which the endless belt with a bent portion is stored, permanent deformation is prevented from occurring in the bent portion of the endless belt.

In the case in which the endless belt is applied to a transfer belt, when permanent deformation occurs in the endless belt, in a region where permanent deformation occurs, deterioration in cleaning properties and deterioration in toner image transferability easily occur. In addition, in the case in which the endless belt is applied to a fixing belt, when permanent deformation occurs in the endless belt, a phenomenon such as deterioration of paper transportability at the time when paper passes through the fixing device or the like easily occurs.

In contrast, in the case in which the endless belt according to the exemplary embodiment is applied to a transfer belt, permanent deformation is prevented from occurring in the bent portion of the endless belt and thus deterioration in cleaning properties and deterioration in toner image transferability are easily prevented. In addition, in the case in which the endless belt is applied to a fixing belt, permanent deformation is prevented from occurring, and thus paper transportability of at the time when paper passes through the fixing device is easily prevented from deteriorating.

Polyimide Resin Layer

Hereinafter, the polyimide precursor composition for obtaining the polyimide resin layer constituting the endless belt will be described.

Polyimide Precursor Composition

The polyimide precursor composition is a polyimide precursor composition including a resin having a repeating unit represented by formula (I) (hereinafter, referred to as a "polyimide precursor"), and at least one solvent selected from a solvent group A consisting of a urea solvent, an alkoxy group-containing amide solvent, and an ester group-containing amide solvent. If required, the polyimide precursor composition may include conductive particles, which will be described later, and other additives.

Polyimide Precursor

The polyimide precursor includes a resin having a repeating unit represented by formula (I) (polyamic acid).

(I)

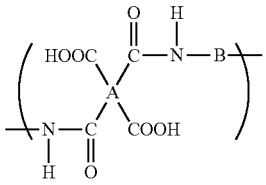

In formula (I), A represents a tetravalent organic group and B represents a divalent organic group.

Here, in formula (I), the tetravalent organic group represented by A is a residue excluding four carboxyl groups from a tetracarboxylic acid dianhydride as a raw material.

On the other hand, the divalent organic group represented by B is a residue excluding two amino groups from a diamine compound as a raw material.

That is, a specific polyimide precursor having a repeating unit represented by formula (I) is a polymer of a tetracarboxylic acid dianhydride and a diamine compound.

Examples of the tetracarboxylic acid dianhydride include aromatic and aliphatic compounds, and the tetracarboxylic acid dianhydride may be an aromatic compound. That is, in formula (I), the tetravalent organic group represented by A may be an aromatic organic group.

Examples of aromatic tetracarboxylic acid dianhydrides include pyromellitic acid dianhydride, 3,3',4,4'-benzophenone tetracarboxylic acid dianhydride, 3,3',4,4'-biphenylsulfone tetracarboxylic acid dianhydride, 1,4,5,8-naphthalene tetracarboxylic acid dianhydride, 2,3,6,7-naphthalene tetracarboxylic acid dianhydride, 3,3',4,4'-biphenylether tetracarboxylic acid dianhydride, 3,3',4,4'-dimethyldiphenylsilane tetracarboxylic acid dianhydride, 3,3',4,4'-tetraphenylsilane tetracarboxylic acid dianhydride, 1,2,3,4-furantetracarboxylic acid dianhydride, 4,4'-bis(3,4-dicarboxyphenoxy)diphenylsulfide dianhydride, 4,4'-bis(3,4-dicarboxyphenoxy)diphenylsulfone dianhydride, 4,4'-bis(3,4-dicarboxyphenoxy) diphenylpropane dianhydride, 3,3',4,4'-perfluoroisopropylidene diphthalic acid dianhydride, 3,3',4,4'-biphenyl tetracarboxylic acid dianhydride, 2,3,3',4'-biphenyl tetracarboxylic acid dianhydride, bis(phthalic) phenylphosphine oxide dianhydride, p-phenylene-bis(triphenylphthalic acid) dianhydride, m-phenylene-bis(triphenylphthalic acid) dianhydride, bis(triphenylphthalic acid)-4,4'-diphenyl ether dianhydride, and bis(triphenylphthalic acid)-4,4'-diphenylmethane dianhydride.

Examples of aliphatic tetracarboxylic acid dianhydrides include aliphatic or alicyclic tetracarboxylic acid dianhydrides, such as butane tetracarboxylic acid dianhydride, 1,2,3,4-cyclobutane tetracarboxylic acid dianhydride, 1,3-dimethyl-1,2,3,4-cyclobutanete tracarboxylic acid dianhydride, 1,2,3,4-cyclopentane tetracarboxylic acid dianhydride, 2,3,5-tricarboxycyclopentyl acetic acid dianhydride, 3,5,6-tricarboxynorbornane-2-acetic acid dianhydride, 2,3,4,5-tetrahydrofuran tetracarboxylic acid dianhydride, 5-(2,5-dioxotetrahydrofuryl)-3-methyl-3-cyclohexene-1,2-di carboxylic acid dianhydride, and bicyclo[2,2,2]-octo-7-ene-2,3,5,6-tetracarboxylic acid dianhydride; and aliphatic tetracarboxylic acid dianhydrides having an aromatic ring, such as 1,3,3a,4,5,9b-hexahydro-2,5-dioxo-3-furanyl-naphtho[1,2-c] furan-1,3-dione, 1,3,3a,4,5,9b-hexahydro-5-methyl-5-(tetrahydro-2,5-dioxo-3-furanyl)-naphtho-[1,2-c] furan-1,3-dione, and 1,3,3a,4,5,9b-hexahydro-8-methyl-5-(tetrahydro-2,5-dioxo-3-furanyl)-naphtho[1,2-c]furan 1,3-dione.

Among these, the tetracarboxylic acid dianhydride may be an aromatic tetracarboxylic acid dianhydride, and specifically, for example, pyromellitic acid dianhydride, 3,3',4,4'-biphenyl tetracarboxylic acid dianhydride, 2,3,3',4'-biphenyl tetracarboxylic acid dianhydride, 3,3',4,4'-biphenyl ether tetracarboxylic acid dianhydride, and 3,3',4,4'-benzophenone tetracarboxylic acid dianhydride are preferable, pyromellitic acid dianhydride, 3,3',4,4'-biphenyl tetracarboxylic acid dianhydride, and 3,3',4,4'-benzophenone tetracarboxylic acid dianhydride are more preferable, and 3,3',4,4'-biphenyl tetracarboxylic acid dianhydride is particularly preferable.

These tetracarboxylic acid dianhydrides may be used alone or in combination of two or more thereof.

In addition, in the case of using two or more tetracarboxylic acid dianhydrides in combination, aromatic tetracarboxylic acid dianhydrides or aliphatic tetracarboxylic acid dianhydrides may be respectively used in combination or an aromatic tetracarboxylic acid dianhydride and an aliphatic tetracarboxylic acid dianhydride may be used in combination.

On the other hand, the diamine compound is a diamine compound having two amino groups in its molecular structure. Examples of the diamine compound include aromatic and aliphatic compounds and the diamine compound may be an aromatic compound. That is, in formula (I), the divalent organic group represented by B may be an aromatic organic group.

Examples of the diamine compound include aromatic diamines, such as p-phenylenediamine, m-phenylenediamine, 4,4'-diaminodiphenylmethane, 4,4'-diaminodiphenylethane, 4,4'-diaminodiphenyl ether, 4,4'-diaminodiphenyl sulfide, 4,4'-diaminodiphenyl sulfone, 1,5-diaminonaphthalene, 3,3-dimethyl-4,4'-diaminobiphenyl, 5-amino-1-(4'-aminophenyl)-1,3,3-trimethyl indan, 6-amino-1-(4'-aminophenyl)-1,3,3-trimethyl indan, 4,4'-diaminobenzanilide, 3,5-diamino-3'-trifluoromethyl benzanilide, 3,5-diamino-4'-trifluoromethyl benzanilide, 3,4'-diaminodiphenyl ether, 2,7-diaminofluorene, 2,2-bis(4-aminophenyl)hexafluoropropane, 4,4'-methylene-bis(2-chloroaniline), 2,2',5,5'-tetrachloro-4,4'-diaminobiphenyl, 2,2'-dichloro-4,4'-diamino-5,5'-dimethoxybiphenyl, 3,3'-dimethoxy-4,4'-diaminobiphenyl, 4,4'-diamino-2,2'-bis(trifluoromethyl) biphenyl, 2,2-bis[(4-(4-aminophenoxy)phenyl)]propane, 2,2-bis[(4-(4-aminophenoxy) phenyl)]hexafluoropropane, 1,4-bis(4-aminophenoxy)benzene, 4,4'-bis(4-aminophenoxy)-biphenyl, 1,3'-bis(4-aminophenoxy)benzene, 9,9-bis(4-aminophenyl)fluorene, 4,4'-(p-phenyleneisopropylidene) bisaniline, 4,4'-(m-phenyleneisopropylidene)bisaniline, 2,2'-bis[(4-(4-amino-2-trifluoromethylphenoxy)phenyl)] hexa fluoropropane, and 4,4'-bis[4-(4-amino-2-trifluoromethyl)phenoxy]-octafluorobiphenyl; aromatic diamines each of which has two amino groups bonded to an aromatic ring and a hetero atom other than nitrogen atoms of the amino groups, such as diaminotetraphenylthiophene; aliphatic diamines and alicyclic diamines, such as 1,1-metaxylylenediamine, 1,3-propanediamine, tetramethylenediamine, pentamethylenediamine, octamethylenediamine, nonamethylenediamine, 4,4-diaminoheptamethylenediamine, 1,4-diaminocyclohexane, isophoronediamine, tetrahydrodicyclopentadienylenediamine, hexahydro-4,7-methanoindanylenedimethylenediamine, tricyclo [6,2,1,$0^{2,7}$]-undecylenedimethydiamine, and 4,4'-methylenebis(cyclohexylamine).

Among these, as the diamine compound, an aromatic diamine compound may be used, and specifically, for example, p-phenylenediamine, m-phenylenediamine, 4,4'-diaminodiphenylmethane, 4,4'-diaminodiphenyl ether, 3,4'-diaminodiphenyl ether, 4,4'-diaminodiphenyl sulfide, and 4,4'-diaminodiphenylsulphone are preferably and 4,4'-diaminodiphenyl ether and p-phenylenediamine are particularly preferable.

The diamine compounds may be used alone or in combination of two or more thereof. In addition, in the case of using two or more diamine compounds in combination, aromatic diamine compounds or aliphatic diamine compounds may be respectively used in combination or an aromatic diamine compound and an aliphatic diamine compound may be used in combination.

The polyimide precursor may be a resin which is partially imidized.

Specifically, as the polyimide precursor, for example, resins having repeating units represented by formulae (I-1), (I-2), and (I-3) may be used.

(I-1)

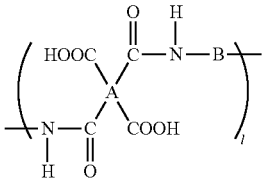

-continued (I-2)

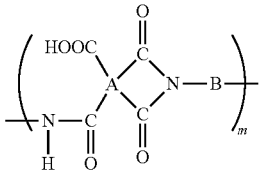

(I-3)

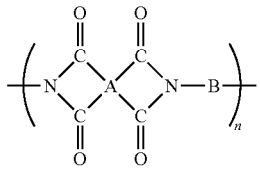

In formulae (I-1), (I-2), and (I-3), A represents a tetravalent organic group and B represents a divalent organic group. A and B are the same as A and B in formula (I).

l represents an integer of 1 or greater and m and n each independently represents 0 or an integer of 1 or greater.

Here, a ratio of the number of bonding portions (2n+m) showing imide ring closure to a total number of bonding portions (2l+2m+2n) in the bonding portions of the polyimide precursor (portions where the tetracarboxylic dianhydride reacts with the diamine compound), that is, the imidization rate of the specific polyimide precursor is represented by "(2n+m)/(2l+2m+2n)". This value is preferably 0.2 or less, more preferably 0.15 or less, and most preferably 0.1 or less.

By controlling the imidization rate to be within the above range, the specific polyimide precursor is prevented from being gelated or separated by precipitation.

The imidization rate of the specific polyimide precursor (the value of "(2n+m)/(2l+2m+2n)") is measured by the following method.

Measurement of Imidization Rate of Polyimide Precursor

Preparation of Polyimide Precursor Sample (i) The polyimide precursor composition to be measured is applied to a silicone wafer to have a film thickness in a range of 1 μm to 10 μm to prepare a coating film sample.

(ii) The coating film sample is immersed in tetrahydrofuran (THF) for 20 minutes, and the solvent in the coating film sample is replaced with tetrahydrofuran (THF). The solvent for immersion is not limited to THF and may be selected from solvents that do not dissolve the polyimide precursor and may be mixed with a solvent component included in the polyimide precursor composition. Specifically, alcohol solvents such as methanol and ethanol and ether compounds such as dioxane may be used.

(iii) The coating film sample is taken out from THF and $N_2$ gas is blown to THF attached to the surface of the coating film sample to remove THF. The coating film sample is dried by being treated for 12 hours or longer at a temperature within a range of 5° C. to 25° C. under a reduced pressure of 10 mmHg or less. Thus, a polyimide precursor sample is prepared.

Preparation of 100% Imidized Standard Sample (iv) The polyimide precursor composition to be measured is applied to a silicone wafer in the same manner as in the above (i) to prepare a coating film sample.

(v) The coating film sample is heated at 380° C. for 60 minutes to conduct an imidization reaction so as to prepare a 100% imidized standard sample.

Measurement and Analysis (vi) By using a Fourier transform infrared spectrophotometer (FT-730, manufactured by Horiba, Ltd.), the infrared spectrum of the 100% imidized standard sample and the polyimide precursor sample is measured. The 100% imidized standard sample is used to obtain a ratio I' (100) of a light absorption peak derived from an imide bonding near 1,780 $cm^{-1}$ (Ab' (1,780 $cm^{-1}$)) to a light absorption peak derived from an aromatic ring near 1,500 $cm^{-1}$ (Ab' (1,500 $cm^{-1}$)).

(vii) Similarly, the polyimide precursor sample is measured to obtain a ratio I (x) of a light absorption peak derived from an imide bonding near 1,780 $cm^{-1}$ (Ab (1,780 $cm^{-1}$)) to a light absorption peak derived from an aromatic ring near 1,500 $cm^{-1}$ (Ab (1,500 $cm^{-1}$)).

Then, the measured light absorption peaks I' (100) and I(x) are respectively used to calculate the imidization rate of the polyimide precursor based on the following Equations.

Equation: Imidization rate of polyimide precursor $=I(x)/I'(100)$

Equation: $I'(100)=(Ab'(1{,}780\ cm^{-1}))/(Ab'(1{,}500\ cm^{-1}))$

Equation: $I(x)=(Ab(1{,}780\ cm^{-1}))/(Ab(1{,}500\ cm^{-1}))$

The measurement of the imidization rate of the polyimide precursor is applied to the measurement of the imidization rate of the aromatic polyimide precursor. In the case of measuring the imidization rate of the aliphatic polyimide precursor, instead of the absorption peak of the aromatic ring, the peak derived from a structure which does not change before and after the imidization reaction is used as an internal standard peak.

Terminal Amino Group of Polyimide Precursor

The specific polyimide precursor may include a polyimide precursor (resin) having an amino group at the terminal thereof and may preferably be a polyimide precursor having amino groups at all terminals thereof.

In order for the specific polyimide precursor to have amino groups at the molecular terminals, for example, the diamine compound used at the time of the polymerization reaction is added in a molar equivalent that is excessively larger than the molar equivalent of the tetracarboxylic acid dianhydride at the time of the polymerization reaction. A ratio of the molar equivalent of the tetracarboxylic acid dianhydride to the molar equivalent of the diamine compound is preferably in a range of 0.92 to 0.9999 and more preferably within a range of 0.93 to 0.999 with respect to 1 molar equivalent of the diamine compound.

As long as ratio of the molar equivalent of the tetracarboxylic acid dianhydride to the molar equivalent of the diamine compound is 0.9 or more, the amino groups on the molecular terminal exert a great effect and good dispersibility is easily obtained. In addition, as long as the molar equivalent ratio is 0.9999 or less, the molecular weight of the polyimide precursor to be obtained is large and for example, when the polyimide resin is formed into a molded article, sufficient strength (tear strength and tensile strength) is easily obtained.

The terminal amino groups of the specific polyimide precursor are detected by causing the trifluoroacetic acid anhydride to act on the polyimide precursor composition (quantitatively reacting with the amino group). That is, the terminal amino groups of the specific polyimide precursor are trifluoroacetylated by the trifluoroacetic acid anhydride. After the treatment, the specific polyimide precursor is purified by reprecipitation or the like to remove excessive trifluoroacetic acid anhydride and trifluoroacetic acid residues. Regarding the specific polyimide precursor after the treatment, the amount of the terminal amino groups of the specific polyimide precursor is measured by determining the amount of fluorine atoms to be introduced in the polyimide precursor by nuclear magnetic resonance (19F-NMR).

The number average molecular weight of the specific polyimide precursor is preferably from 5,000 to 100,000, more preferably from 7,000 to 50,000, and still more preferably from 10,000 to 30,000.

When the number average molecular weight of the specific polyimide precursor is within the above range, the solubility of the polyimide precursor in the composition and the mechanical characteristics of a film after film formation are good.

Incidentally, a specific polyimide precursor having a desired number average molecular weight may be obtained by adjusting the ratio between the molar equivalent of the tetracarboxylic acid dianhydride and the molar equivalent of the diamine compound.

The number average molecular weight of the specific polyimide precursor is measured by a gel permeation chromatography (GPC) method under the following measurement conditions.

Column: TSKgel α-M (7.8 mm I.D×30 cm) manufactured by Tosoh Corporation

Eluant: dimethylformamide (DMF)/30 mM LiBr/60 mM phosphoric acid

Flow rate: 0.6 mL/min

Injection amount: 60 μL

Detector: RI (differential refractive index detector)

The content (concentration) of the specific polyimide precursor may be from 0.1% by weight to 40% by weight, is preferably from 0.5% by weight to 25% by weight, and more preferably from 1% by weight to 20% by weight with respect to the entire polyimide precursor composition.

Solvent Group A

First, the content of the solvent of the solvent group A contained in the polyimide resin layer will be described.

Content of Solvent of Solvent Group A

The endless belt according to the exemplary embodiment contains at least one solvent selected from a solvent group A consisting of a urea solvent, an alkoxy group-containing amide solvent, and an ester group-containing amide solvent in the polyimide resin layer constituting the endless belt in an amount in a range of 50 ppm to 2,000 ppm based on weight. In the bent portion of the endless belt, from the viewpoint of preventing permanent deformation from occurring, the content of the solvent of the solvent group A is preferably from 70 ppm to 1,500 ppm and more preferably from 100 ppm to 1,000 ppm.

The content of at least one solvent selected from the solvent group A refers to the total amount of solvents of the solvent group A and is a content with respect to the entire polyimide resin layer.

Here, the method of controlling the content of the solvent of the solvent group A contained in the polyimide resin layer constituting the endless belt according to the exemplary embodiment to be within a range of 50 ppm to 2,000 ppm is not particularly limited. For example, the following methods may be used.

In the case of blast drying, for example, a method of controlling a blast speed; and rotating an endless belt, and controlling the rotation speed thereof, and the like may be used. In addition, in the case of using a metal mold, a method of chaining the thickness of the metal mold and controlling the heat capacity; and controlling the temperature of the metal mold, and the like may be used.

The solvent (residual solvent) contained in the polyimide resin layer constituting the endless belt may be measured with a gas chromatography mass spectrometer (GC-MS) and the like by collecting a sample for measurement from the polyimide resin layer of the endless belt to be measured. Specifically, a gas chromatography mass spectrophotometer (GCMSQP-2010, manufactured by Shimadzu Corporation) in which a falling type pyrolysis device (PY-2020D, manufactured by Frontier Laboratories Ltd.) is installed may be used for analysis.

The solvent contained in the polyimide resin layer constituting the endless belt is measured at a thermal decomposition temperature of 400° C. by exactly weighing 0.40 mg of a sample for measurement from the polyimide resin layer.

Pyrolysis device: PY-2020D: manufactured by Frontier Laboratories Ltd.

Gas chromatography mass spectrophotometer: GCMS QP-2010, manufactured by Shimadzu Corporation Thermal decomposition temperature: 400° C.

Gas chromatography introduction temperature: 280° C.

Inject method: split ratio: 1:50

Column: Ultra ALLOY-5, 0.25 μm, 0.25 μm ID, 30 m: manufactured by Frontier Laboratories Ltd.

Gas chromatography temperature program: the temperature is increased from 40° C. to 280° C. at a rate of 20° C./min and then kept for 10 minutes Mass range: EI, m/z=29-600 For example, in the case of using the endless belt as an intermediate transfer belt, the common logarithm value of the surface resistivity of the outer circumferential surface thereof is preferably from 8 (Log Ω/square) to 13 (Log Ω/square) and more preferably from 8 (Log Ω)/square) to 12 (Log Ω/square). When the common logarithm value of the surface resistivity is greater than 13 (Log Ω/square), the intermediate transfer member electrostatically attracts the recording medium at the time of secondary transfer and the recording medium is hardly released in some cases. On the other hand, when the common logarithm value of the surface resistivity is less than 8 (Log Ω/square), the toner image holding force that is primarily transferred to the intermediate transfer member is not sufficient and granularity in image quality or image defects are generated in some cases.

The common logarithm value of the surface resistivity is controlled by the type of the conductive particles and the amount of the conductive particles to be added.

Hereinafter, the solvent of the solvent group A will be described in detail.

Urea Solvent

The urea solvent is a solvent having a urea group (N—C(=O)—N). Specifically, the urea solvent may be a solvent having a "*—N($Ra^1$)—C(=O)—N($Ra^2$)—*" structure. Here, $Ra^1$ and $Ra^2$ each independently represent a hydrogen atom, an alkyl group, a phenyl group, or a phenyl alkyl group. Both terminals* of two N atoms are bonding portions with a group of other atoms having the above structure. The urea solvent may be a solvent having a ring structure in which both terminals* of two N atoms are linked via, for example, alkylene, —O—, —C(=O)—, or a linking group of a combination thereof.

The alkyl group represented by $Ra^1$ and $Ra^2$ may be chained, branched, or cyclic, and may have a substituent. Specific example of the alkyl group include alkyl groups having 1 to 6 carbon atoms (preferably 1 to 4 carbon atoms)

(for example, a methyl group, an ethyl group, a n-propyl group, an i-propyl group, and a n-butyl group).

Examples of the substituent of the alkyl group include an alkoxy group having 1 to 4 carbon atoms, a hydroxyl group, a ketone group, an ester group, and an alkyl carbonyloxy group.

Specific examples of the ketone group include a methyl carbonyl group (acetyl group), an ethyl carbonyl group, and a n-propyl carbonyl group. Specific examples of the ester group include a methoxy carbonyl group, an ethoxy carbonyl group, a n-propoxy carbonyl group, and an acetoxy group. Specific examples of the alkyl carbonyloxy group include a methyl carbonyloxy group (acetyloxy group), an ethyl carbonyloxy group, and a n-propyl carbonyloxy group.

The phenyl skeleton of the phenyl group or the phenyl alkyl group represented by $Ra^1$ and $Ra^2$ may have a substituent. The substituent in the phenyl skeleton includes the same substituents of the above alkyl group.

In the case in which the urea solvent has the ring structure in which the both terminals* of the above two N atoms are linked, the number of ring members may be 5 or 6.

Examples of the urea solvent include 1,3-dimethyl urea, 1,3-diethyl urea, 1,3-diphenyl urea, 1,3-dicyclohexyl urea, tetramethyl urea, tetraethyl urea, 2-imidazolidinone, propylene urea, 1,3-dimethyl-2-imidazolidinone, and N,N-dimethyl propylene urea.

Among these, from the viewpoints of preventing cracking of molded article of polyimide resin from occurring and improving storage stability at room temperature and in a refrigerated state, as the urea solvent, 1,3-dimethyl urea, 1,3-diethyl urea, tetramethyl urea, tetraethyl urea, 1,3-dimethyl-2-imidazolidinone, and N,N-dimethyl propylene urea are preferable, and tetramethyl urea, tetraethyl urea, 1,3-dimethyl-2-imidazolidinone, and N,N-dimethyl propylene urea are most preferable.

Alkoxy Group-Containing Amide Solvent and Ester Group-Containing Amide Solvent

The alkoxy group-containing amide solvent is a solvent having an alkoxy group and an amide group. On the other hand, the ester group-containing amide solvent is a solvent having an ester group and an amide group. As the alkoxy group and the ester group, the same groups as the alkoxy groups and the ester groups exemplified as the "substituent of the alkyl group represented by $Ra^1$ and $Ra^2$" in the description of the urea solvent may be used. The alkoxy group-containing amide solvent may have an ester group and the ester group-containing amide solvent may have an alkoxy group.

Hereinafter, both the alkoxy group-containing amide solvent and the ester group-containing amide solvent will be referred to as an "alkoxy group- or ester group-containing amide solvent".

The alkoxy group- or ester group-containing amide solvent is not particularly limited and specifically, an amide solvent represented by the following formula (Am1), an amide solvent represented by the following formula (Am2), and the like may be suitably used.

(Am1)

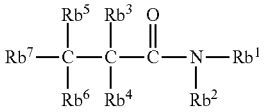

In formula (Am1), $Rb^1$, $Rb^2$, $Rb^3$, $Rb^4$, $Rb^5$, and $Rb^6$ are each independently represent a hydrogen atom, or an alkyl group. $Rb^7$ represents an alkoxy group or an ester group.

The alkyl group represented by $Rb^1$ to $Rb^6$ is the same as the "alkyl group represented by $Ra^1$ and $Ra^2$" in the description of the urea solvent.

As the alkoxy group and the ester group represented by $Rb^7$, the same groups as the alkoxy groups and the ester groups exemplified as the "substituent of the alkyl group represented by $Ra^1$ and $Ra^2$" in the description of the urea solvent may be used.

Hereinafter, specific examples of the amide solvent represented by formula (Am1) will be shown but the amide solvent is not limited thereto.

| Exemplified compound No. | $Rb^1$ | $Rb^2$ | $Rb^3$ | $Rb^4$ | $Rb^5$ | $Rb^6$ | $Rb^7$ |
|---|---|---|---|---|---|---|---|
| B-1 | Me | Me | H | H | H | H | —$CO_2Me$ |
| B-2 | Me | Me | H | H | H | H | —$CO_2Et$ |
| B-3 | Et | Et | H | H | H | H | —$CO_2Me$ |
| B-4 | Me | Me | H | H | H | H | —OMe |
| B-5 | Me | Me | H | H | H | H | —OEt |
| B-6 | Me | Me | H | H | H | H | —OnPr |
| B-7 | Me | Me | H | H | H | H | —OnBu |
| B-8 | Et | Et | H | H | H | H | —OMe |
| B-9 | Me | Me | H | H | H | H | —OC(=O)Me |
| B-10 | Me | Me | Me | H | H | H | —OMe |

In the specific examples of the amide solvent represented by formula (Am1), Me represents a methyl group, Et represents an ethyl group, nPr represents a n-propyl group, and a nBu represents a n-butyl group.

(Am2)

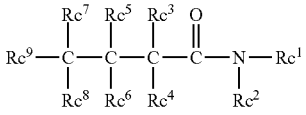

In formula (Am2), $Rc^1$, $Rc^2$, $Rc^3$, $Rc^4$, $Rc^5$, $Rc^6$, $Rc^7$, and $Rc^8$ each independently represent a hydrogen atom or an alkyl group. $Rc^9$ represents an alkoxy group or an ester group.

The alkyl group represented by $Rc^1$ to $Rc^8$ is the same as the "alkyl group represented by $Ra^1$ and $Ra^2$" in the description of the urea solvent.

As the alkoxy group and the ester group represented by $Rc^9$, the same groups as the alkoxy groups and the ester groups exemplified as the "substituent of the alkyl group represented by $Ra^1$ and $Ra^2$" in the description of the urea solvent may be used.

Hereinafter, specific examples of the amide solvent represented by formula (Am2) will be shown but the amide solvent is not limited thereto.

| Exemplified compound No. | $Rc^1$ | $Rc^2$ | $Rc^3$ | $Rc^4$ | $Rc^5$ | $Rc^6$ | $Rc^7$ | $Rc^8$ | $Rc^9$ |
|---|---|---|---|---|---|---|---|---|---|
| C-1 | Me | Me | H | H | H | H | H | H | —$CO_2Me$ |
| C-2 | Me | Me | Me | H | H | H | H | H | —$CO_2Me$ |
| C-3 | Me | Me | H | H | H | H | Me | H | —$CO_2Me$ |
| C-4 | Et | Et | H | H | H | H | H | H | —OMe |
| C-5 | Me | Me | H | H | Me | H | H | H | —$CO_2Me$ |
| C-6 | Me | Me | H | H | H | H | H | H | —$CO_2Et$ |
| C-7 | Me | Me | H | H | H | H | Me | H | —$CO_2Et$ |

-continued

| Exemplified compound No. | $Rc^1$ | $Rc^2$ | $Rc^3$ | $Rc^4$ | $Rc^5$ | $Rc^6$ | $Rc^7$ | $Rc^8$ | $Rc^9$ |
|---|---|---|---|---|---|---|---|---|---|
| C-8 | Me | Me | H | H | H | H | H | H | —OC(=O)Me |
| C-9 | Me | Me | H | H | H | H | H | H | —OEt |
| C-10 | Me | Me | H | H | H | H | H | H | —OnPr |

In the specific examples of the amide solvent represented by formula (Am2), Me represents a methyl group, Et represents an ethyl group, and nPr represents a n-propyl group.

Among these, in the case in which the endless belt with a bent portion is stored, from the viewpoint of preventing permanent deformation from occurring in the bent portion of the endless belt, as the alkoxy group- or ester group-containing amide solvent, 3-methoxy-N,N-dimethylpropanamide (Exemplified compound B-4), 3-n-butoxy-N,N-dimethylpropanamide (Exemplified compound B-7), and 5-dimethylamino-2-methyl-5-oxo-pentane acid methyl (Exemplified compound C-3) are preferable, and 3-methoxy-N,N-dimethylpropanamide (Exemplified compound B-4) is more preferable.

In the case in which the endless belt with a bent portion is stored, from the viewpoint of preventing permanent deformation from occurring in the bent portion of the endless belt, it is preferable that the solvent group A including organic solvents is a solvent group consisting of tetramethyl urea, tetraethyl urea, 1,3-dimethyl-2-imidazolidinone, N,N-dimethylpropylene urea, and 3-methoxy-N,N-dimethylpropanamide. From the same viewpoint, 1,3-dimethyl-2-imidazolidinone is more preferable.

Incidentally, 1,3-dimethyl-2-imidazolidinone has two nitrogen atoms of amino group in one molecule. Therefore, for example, compared with N-methylpyrrolidone which is used as a solvent used in the related art and has only one nitrogen atom of amino group in one molecule, the interaction between 1,3-dimethyl-2-imidazolidinone and the polyamide imide resin easily occurs. Further, since 1,3-dimethyl-2-imidazolidinone has a cyclic structure and a stable conformation, for example, compared with acyclic tetramethyl urea, the interaction between 1,3-dimethyl-2-imidazolidinone and the polyamide imide resin easily occurs, and thus it is assumed that 1,3-dimethyl-2-imidazolidinone is a more suitable solvent.

Boiling Point of Solvent of Solvent Group A

The boiling point of the solvent of the solvent group A (each solvent of the above specific solvent group A) is, for example, preferably from 100° C. to 350° C., more preferably from 120° C. to 300° C., and still more preferably from 150° C. to 250° C. When the boiling point of the solvent of the solvent group A is set to from 100° C. to 350° C., the amount of the solvent of the solvent group A remaining in the endless belt is easily controlled to be within a range from 50 ppm to 2,000 ppm based on weight.

Conductive Particles

The polyimide resin layer constituting the endless belt according to the exemplary embodiment may include conductive particles to be added to impart conductivity, if required. Examples of the conductive particles include conductive particles with conductivity (for example, volume resistivity is less than $10^7$ Ω·cm, the same will be applied), or semiconductivity (for example, volume resistivity is $10^7$ Ω·cm to $10^{13}$ Ω·cm, the same will be applied), and the conductive particles are selected according to the purpose of use.

Examples of the conductive particles include carbon black, metals (for example, aluminum and nickel), metal oxides (for example, yttrium oxide and tin oxide), and ion conductive materials (for example, potassium titanate and LiCl).

These conductive particles may be used alone or in combination of two or more thereof. The primary particle diameter of the conductive particles may be less than 10 μm (preferably 1 μm or less).

Among these, as the conductive particles, carbon black may be used and particularly acidic carbon black of pH 5.0 or less may be used.

As acidic carbon black, carbon black whose surface is treated with acid, for example, carbon black obtained by providing a carboxyl group, a quinone group, a lactone group, a hydroxyl group, and the like on the surface may be used.

As the acidic carbon black, for example, in the case in which a polyimide resin molded article to be obtained is applied to the transfer belt having the polyimide resin molded article as a polyimide resin layer, from the viewpoint of stability of electric resistance with time and electric field dependency of preventing electric field concentration which may be caused by transfer voltage, carbon black of pH 4.5 or less is preferable, and acidic carbon black of pH 4.0 or less is more preferable.

The pH of the acidic carbon black is a value measured by a pH measuring method according to JIS 28802 (2011).

Specific examples of the carbon black include "SPECIAL BLACK 350", "SPECIAL BLACK 100", "SPECIAL BLACK 250", "SPECIAL BLACK 5", "SPECIAL BLACK 4", "SPECIAL BLACK 4A", "SPECIAL BLACK 550", "SPECIAL BLACK 6", "COLOR BLACK FW200", "COLOR BLACK FW2", and "COLOR BLACK FW2V", which are all manufactured by Orion Engineered Carbons Co., Ltd., and "MONARCH1000", "MONARCH1300", "MONARCH' 400", "MOGUL-L" and "REGAL40 OR", which are all produced by Cabot Corporation.

The content of the conductive particles is not particularly limited and from the viewpoint of the external, mechanical, and electrical quality of the endless belt, may be 1 part by weight to 40 parts by weight (preferably from 10 parts by weight to 30 parts by weight) with respect to 100 parts by weight of the polyimide resin of the polyimide resin layer. The conductive particles may be included in the above polyimide precursor composition to obtain the polyimide resin layer.

Other Additives

The polyimide resin layer constituting the endless belt according to the exemplary embodiment may include various fillers for the purpose of imparting various functions such as mechanical strength. In addition, the polyimide resin layer may include a catalyst for accelerating an imidization reaction, a leveling material for improving the quality of a formed film, and the like.

Examples of the filler to be added for improving mechanical strength include particle-shaped materials such as silica powder, alumina powder, barium sulfate powder, titanium oxide powder, mica, and talc. In addition, in order to improve the water repellency and the release properties of the surface of the polyimide resin layer, fluororesin powder such as polytetrafluoroethylene (PTFE) and tetrafluoroethylene-perfluoro alkyl vinyl ether copolymer (PFA), and the like may be added.

As the catalyst for accelerating an imidization reaction, dehydrating agents such as acid anhydride, phenol derivatives, and acid catalysts such as sulfonic acid derivatives and benzoic acid derivatives may be used.

In order to improve the quality of a film made of the polyimide resin layer, a surfactant may be added, and as the surfactant, any of cationic, anionic, and nonionic surfactants may be used.

The content of other additives may be selected according to the desired characteristics of the polyimide resin layer. Other additives may be included in the polyimide precursor composition for obtaining the polyimide resin layer described above.

Method of Preparing Polyimide Precursor Composition

The method of preparing the polyimide precursor composition is not particularly limited. For example, the polyimide precursor may be obtained by polymerizing tetracarboxylic acid dianhydride and a diamine compound in a solvent containing at least one organic solvent selected from the solvent group A.

The reaction temperature at the time of the polymerization reaction of the polyimide precursor may be, for example, 0° C. to 70° C., preferably 10° C. to 60° C., and more preferably 20° C. to 55° C. By setting the reaction temperature to 0° C. or higher, the advance of the polymerization reaction is accelerated and the time required for the reaction is shortened. Thus, productivity is easily improved. On the other hand, when the reaction temperature is set to 70° C. or lower, the advance of the imidization reaction occurring in the molecules of the prepared polyimide precursor is prevented and precipitation or gelation according to deterioration in the solubility of the polyimide precursor is easily prevented.

The time for the polymerization reaction of the polyimide precursor may be set to be within a range of 1 hour to 24 hours depending on the reaction temperature.

Method of Preparing Endless Belt

The endless belt according to the exemplary embodiment has a polyimide resin layer obtained by applying the polyimide precursor composition to an object to be coated as an endless belt forming coating liquid and then drying and sintering the coating film. As the method of preparing the endless belt, specifically, for example, the following methods may be used.

The method of preparing the endless belt includes, for example, a process of forming a coating film by applying a polyimide precursor composition to a cylindrical substrate (metal mold), a process of forming a dried film by drying the coating film formed on the substrate, a process of forming a polyimide resin molded article by imidizing (heating) the dried film and imidizing the polyimide precursor, and a process of forming an endless belt by detaching the polyimide resin molded article from the substrate. The polyimide resin molded article becomes the polyimide resin layer. Specifically, for example, the method is as follows.

First, the polyimide precursor composition is applied to the inner or outer surface of a cylindrical substrate to form a coating film. As the cylindrical substrate, for example, a cylindrical metal substrate is suitably used. Instead of using a metal substrate, substrates made of other materials such as resin, glass, and ceramic may be used. In addition, the surface of the substrate may be coated with glass or ceramic, or a silicone- or fluorine release agent may be used.

Here, in order to accurately apply the polyimide precursor composition, a process of defoaming the polyimide precursor composition before application may be carried out. By defoaming the polyimide precursor composition, bubbles at the time of application and defects of the coating film are prevented from being generated.

As the method of defoaming the polyimide precursor composition, a pressure reduction method, a centrifugal separation method, and the like may be used. Defoaming under reduced pressure is suitable due to simplicity and remarkable defoaming performance.

Next, the cylindrical substrate on which the coating film of the polyimide precursor composition is heated or placed in a vacuum environment to dry the coating film to form a dried film. 30% by weight or more, preferably 50% by weight or more of the solvent contained is volatilized.

Next, the dried film is imidized (heated). By this treatment, a polyimide resin molded article is formed.

Heating for the imidization treatment is carried out under the heating conditions of, for example, a temperature from 150° C. to 400° C. (preferably a temperature of 200° C. to 300° C.) and a heating time of 20 minutes to 60 minutes to cause an imide reaction. Thus, a polyimide resin molded article is formed. Before the temperature reaches the final heating temperature at the time of the heating reaction, the heating may be carried out by slowly raising the temperature in stepwise or at a constant rate. The temperature of imidization varies with, for example, types of the tetracarboxylic dianhydride and diamine used as raw materials. If the degree of imidization is insufficient, mechanical and electric characteristics deteriorate, so the temperature is set such that the imidization is completed.

Then, the polyimide resin molded article is detached from the cylindrical substrate to obtain an endless belt.

In the endless belt according to the exemplary embodiment, the polyimide resin molded article may be used as a single layer as it is to form an endless belt having a polyimide resin layer. In addition, the polyimide resin molded article may be used as a laminate having a functional layer such as a release layer or the like on at least one of the inner and outer circumferential surfaces of the polyimide resin molded article to form an endless belt having a polyimide resin layer.

Examples of Use of Endless Belt

The endless belt according to the exemplary embodiment may be used as, for example, an endless belt for an electrophotographic image forming apparatus. Examples of the endless belt for an electrophotographic image forming apparatus include an intermediate transfer belt, a transfer belt (recording medium transport belt), a fixing belt (heating belt, pressure belt), and a transport belt (recording medium transport belt). The endless belt according to the exemplary embodiment may be also used as, for example, belt-shaped members such as a transport belt, a driving belt, a laminate belt, an electric insulating material, a pipe coating material, an electromagnetic wave-insulating material, a heat source insulating material, and an electromagnetic wave absorbing film, other than the endless belt for an image forming apparatus.

Image Forming Apparatus

The image forming apparatus according to the exemplary embodiment has the above endless belt. In the case in which the endless belt is applied to a belt such as an intermediate transfer belt, a transfer belt, and a transport belt (recording medium transport belt), as the image forming apparatus according to the exemplary embodiment, for example, an image forming apparatus shown below may be adopted.

An image forming apparatus including an image holding member, a charging unit that charges a surface of the image holding member, an electrostatic charge image forming unit that forms an electrostatic charge image on a charged surface of the image holding member, a developing unit that forms a toner image by developing the electrostatic charge image formed on the surface of the image holding member with a developer including a toner, and a transfer unit that transfers the toner image to a surface of a recording medium via the endless belt according to the exemplary embodiment may be adopted.

The transfer unit may have the endless belt unit which will be described later.

Specifically, the image forming apparatus according to the exemplary embodiment may have a configuration in which, for example, the transfer unit includes an intermediate transfer member, a primary transfer unit that primarily transfers the toner image formed on the image holding member to the intermediate transfer member, and a secondary transfer unit that secondarily transfers the toner image transferred to the intermediate transfer member to a recording medium, and includes the endless belt according to the exemplary embodiment as the intermediate transfer member.

In addition, the image forming apparatus according to the exemplary embodiment may have a configuration in which, for example, the transfer unit includes a recording medium transport member (recording medium transport belt) for transporting a recording medium, and a transfer unit for transferring the toner image formed on the image holding member to a recording medium transported by the recording medium transport member, and includes the endless belt according to the exemplary embodiment as the recording medium transport member.

On the other hand, in the case in which the endless belt is applied to a belt such as a fixing belt (heating belt, pressure belt), as the image forming apparatus according to the exemplary embodiment, for example, an image forming apparatus shown below may be adopted.

The image forming apparatus includes an image holding member, a charging unit that charges a surface of the image holding member, an electrostatic charge image forming unit that forms an electrostatic charge image on a charged surface of the image holding member, a developing unit that forms a toner image by developing the electrostatic charge image formed on the surface of the image holding member with a developer including a toner, and a transfer unit that transfers the toner image to a recording medium, and a fixing unit that fixes the toner image to the recording medium. As the fixing unit, a fixing device including a first rotary member, and a second rotary member that is disposed to be in contact with an outer surface of the first rotary member, in which at least one of the first rotary member and the second rotary member is the endless belt according to the exemplary embodiment, is used.

Examples of the image forming apparatus according to the exemplary embodiment include an ordinary mono color image forming apparatus containing only a monochromatic toner in the developing device, a color image forming apparatus of successively repeating primary transferring of a toner image held on an image holding member to an intermediate transfer member, and a tandem type color image forming apparatus wherein plural image holding members each equipped with a developing device of each color are disposed in series on an intermediate transfer member.

Hereinafter, the image forming apparatus according to the exemplary embodiment will be described with reference to the drawings.

FIG. 1 is a schematic configuration diagram showing an example of an image forming apparatus according to the exemplary embodiment. The image forming apparatus shown in FIG. 1 is an image forming apparatus in which the endless belt according to the exemplary embodiment is applied to an intermediate transfer member (intermediate transfer belt).

As shown in FIG. 1, for example, an image forming apparatus 100 according to the exemplary embodiment is of a so-called tandem type, and charging devices 102*a* to 102*d*, exposure devices 114*a* to 114*d*, developing devices 103*a* to 103*d*, primary transfer devices (primary transfer rolls) 105*a* to 105*d*, image holding member cleaning devices 104*a* to 104*d* are disposed around four image holding members 101*a* to 101*d* formed of electrophotographic photoreceptors sequentially along the rotation direction thereof. In addition, in order to remove residual potentials remaining on the surfaces of the image holding members 101*a* to 101*d* after transfer, an erasing device may be included.

While receiving tension, an intermediate transfer belt 107 is supported by supporting rolls 106*a* to 106*d*, a driving roll 111, and a counter roll 108 to form an endless belt unit 107*b*. By these supporting rolls 106*a* to 106*d*, the driving roll 111, and the counter roll 108, the intermediate transfer belt 107 may cause each of the image holding members 101*a* to 101*d* and the primary transfer rolls 105*a* to 105*d* to move in the direction of an arrow A while contacting the surfaces of each of the image holding members 101*a* to 101*d*. Portions in which the primary transfer rolls 105*a* to 105*d* contact the image holding members 101*a* to 101*d* via the intermediate transfer belt 107 become primary transfer portions, and the primary transfer voltage is applied to contact portions between the image holding members 101*a* to 101*d* and the primary transfer rolls 105*a* to 105*d*.

As a secondary transfer device, the counter roll 108 and a secondary transfer roll 109 are disposed to face each other via the intermediate transfer belt 107 and a secondary transfer belt 116. The secondary transfer belt 116 is supported by the secondary transfer roll 109 and a support roll 106*e*. A recording medium 115 such as paper moves in the direction of an arrow B in an area sandwiched by the intermediate transfer belt 107 and the secondary transfer roll 109 while contacting the surface of the intermediate transfer belt 107, and then passes through a fixing device 110. A portion in which the secondary transfer roll 109 contacts the counter roll 108 via the intermediate transfer belt 107 and the secondary transfer belt 116 becomes a secondary transfer portion, and thus a secondary transfer voltage is applied to a contact portion between the secondary transfer roll 109 and the counter roll 108. Further, intermediate transfer belt cleaning devices 112 and 113 are disposed so as to contact the intermediate transfer belt 107 after transfer.

In the multiple color image forming apparatus 100 having the configuration described above, an image holding member 101*a* rotates in the direction of an arrow C, the surface thereof is charged by a charging device 102*a*, and then an electrostatic charge image of a first color is formed by the exposure device 114*a* of laser light or the like. By the developing device 103*a* accommodating toner corresponding to the color, the formed electrostatic charge image is developed (visualized) with a developer including the toner to form a toner image. In addition, toners (for example, yellow, magenta, cyan, and black) corresponding to electrostatic charge images of the respective colors are accommodated in the developing devices 103*a* to 103*d*.

When the toner image formed on the image holding member 101*a* passes through the primary transfer portion, the toner image is electrostatically transferred (primarily transferred) to the intermediate transfer belt 107 by the primary transfer roll 105*a*. Thereafter, toner images of second, third, and fourth colors are primarily transferred to the intermediate transfer belt 107 that holds the toner image of the first color by the primary transfer rolls 105*b* to 105*d* in a sequentially superimposed manner. Finally, multiple toner images of multiple colors are obtained.

The multiple toner images formed on the intermediate transfer belt 107 are collectively and electrostatically transferred to the recording medium 115 when passing through the secondary transfer portion. The recording medium 115 to which the toner images transferred is transported to the fixing device 110, is subjected to a fixing treatment by heating and pressing or at least one of heating and pressing, and is discharged to the outside of the apparatus.

In the image holding members 101*a* to 101*d* after primary transfer, residual toner is removed by the image holding member cleaning devices 104*a* to 104*d*. On the other hand, in the intermediate transfer belt 107 after secondary transfer, residual toner is removed by the intermediate transfer belt cleaning devices 112 and 113, and the intermediate transfer belt 107 prepares for the next image forming process.

Image Holding Member

A known electrophotographic photoreceptor is widely used as the image holding members 101*a* to 101*d*. As the electrophotographic photoreceptor, an inorganic photoreceptor in which the photosensitive layer is formed of an inorganic material, or an organic photoreceptor in which the photosensitive layer is formed of an organic material is used. With respect to the organic photoreceptor, a function separation type organic photoreceptor obtained by stacking a charge generating layer that generates electric charges by exposure and an electric charge transporting layer that transports the electric charges, or a single layer type organic photoreceptor that accomplishes a function of generating electric charges and a function of transporting electric charges is suitably used. Also, with respect to the inorganic photoreceptor, a photoreceptor in which a photosensitive layer is formed of amorphous silicon is suitably used.

In addition, the formation of the image holding member is not particularly limited. For example, known shapes such as a cylindrical drum shape, a sheet-shaped shape, and a plate-shaped shape are employed.

Charging Device

The charging devices 102*a* to 102*d* are not particularly limited. For example, known chargers such as contact type chargers using conductive (here, the term "conductive" in a charging device means that, for example, volume resistivity is less than $10^7$ Ω·cm) or semiconductive (here, the "semiconductive" in a charging device means that, for example, volume resistivity is $10^7$ Ω·cm to $10^{13}$ Ω·cm) rollers, brushes, films, or rubber blades, scorotron chargers that use corona discharges, or corotron chargers are widely applied. Among these, the contact type charger is preferable.

The charging devices 102*a* to 102*d* generally apply direct currents to the image holding members 101*a* to 101*d*, but may further apply alternate currents in a superimposed manner.

Exposure Device

The exposure devices 114*a* to 114*d* are not particularly limited. However, for example, as the exposure devices 114*a* to 114*d*, known exposure devices such as an optical device that may perform exposure according to an image data on the surfaces of the image holding members 101*a* to 101*d* with light from a light source such as semiconductor laser light, light emitting diode (LED) light, or liquid crystal shutter light or with light transmitted from the light sources via a polygon mirror are widely applied.

Developing Device

The developing devices 103*a* and 103*d* are selected according to the purpose of use. For example, a known developing device that develops a single component developer or a two component developer by using a brush, a roller, or the like on a contact or contactless manner may be used.

Primary Transfer Roll

The primary transfer rolls 105*a* to 105*d* may have a single layer structure or a multiple layer structure. For example, in the case of the single layer structure, the primary transfer rolls 105*a* to 105*d* are configured with rolls in which proper quantities of conductive particles such as carbon black are blended with foamed or non-foamed silicone rubber, urethane rubber, EPDM, or the like.

Image Holding Member Cleaning Device

The image holding member cleaning devices 104*a* to 104*d* are provided to remove residual toner attached to the surfaces of the image holding members 101*a* to 101*d* after the primary transfer process, brush cleaning or roll cleaning may be performed instead of using other than a cleaning blade. Among these, a cleaning blade is preferably used. In addition, as a material for the cleaning blade, urethane rubber, neoprene rubber, or silicone rubber may be used.

Secondary Transfer Roll

The layer structure of the secondary transfer roll 109 is not particularly limited. For example, in the case of the three layer structure, the secondary transfer roll is configured with a core layer, an intermediate layer, and a coating layer that covers a surface thereof. The core layer is configured with a foaming member of silicone rubber, urethane rubber, EPDM, or the like, in which conductive particles are dispersed, and the intermediate layer is configured with a non-foaming member thereof. As a material for the coating layer, a tetrafluoroethylene-hexafluoropropylene copolymer, or a perfluoroalkoxy resin may be used.

The volume resistivity of the secondary transfer roll 109 is preferably $10^7$ Ω·cm or less. In addition, the secondary transfer roll 109 may have a two layer structure excluding the intermediate layer.

Counter Roll

The counter roll 108 forms a counter electrode of the secondary transfer roll 109. The layer structure of the counter roll 108 may be a single layer structure or a multiple layer structure. For example, in the case of the single layer structure, the counter roll 108 is configured with a roll in which proper quantities of conductive particles such as carbon black are blended with silicone rubber, urethane rubber, EPDM, or the like. In the case of the two layer structure, the counter roll 108 is configured with a roll obtained by covering an outer circumferential surface of an elastic layer configured with the rubber materials described above with a high resistance layer.

A voltage of 1 kV to 6 kv is generally applied to shafts of the counter roll 108 and the secondary transfer roll 109. Instead of the application of the voltage to the shaft of the counter roll 108, a voltage may be applied to an electrode member with excellent conductivity that comes into contact with the counter roll 108 and the secondary transfer roll 109. As the electrode member, a metal roll, a conductive rubber roll, a conductive brush, a metal plate, or a conductive resin plate, or the like may be used.

Fixing Device

For example, as the fixing device 110, known fixing devices such as a heating roller fixing device, a pressure roller fixing device, and a flash fixing device are widely applied.

Intermediate Transfer Belt Cleaning Device

As the intermediate transfer belt cleaning devices 112 and 113, in addition to the cleaning blade, brush cleaning, roll cleaning, and the like may be used, and among them, the cleaning blade is preferably used. In addition, as the material for the cleaning blade, urethane rubber, neoprene rubber, silicone rubber, or the like may be used.

Next, an image forming apparatus in which the endless belt according to the exemplary embodiment is used as a recording medium transport member (paper transport belt) will be described.

Figure 2:
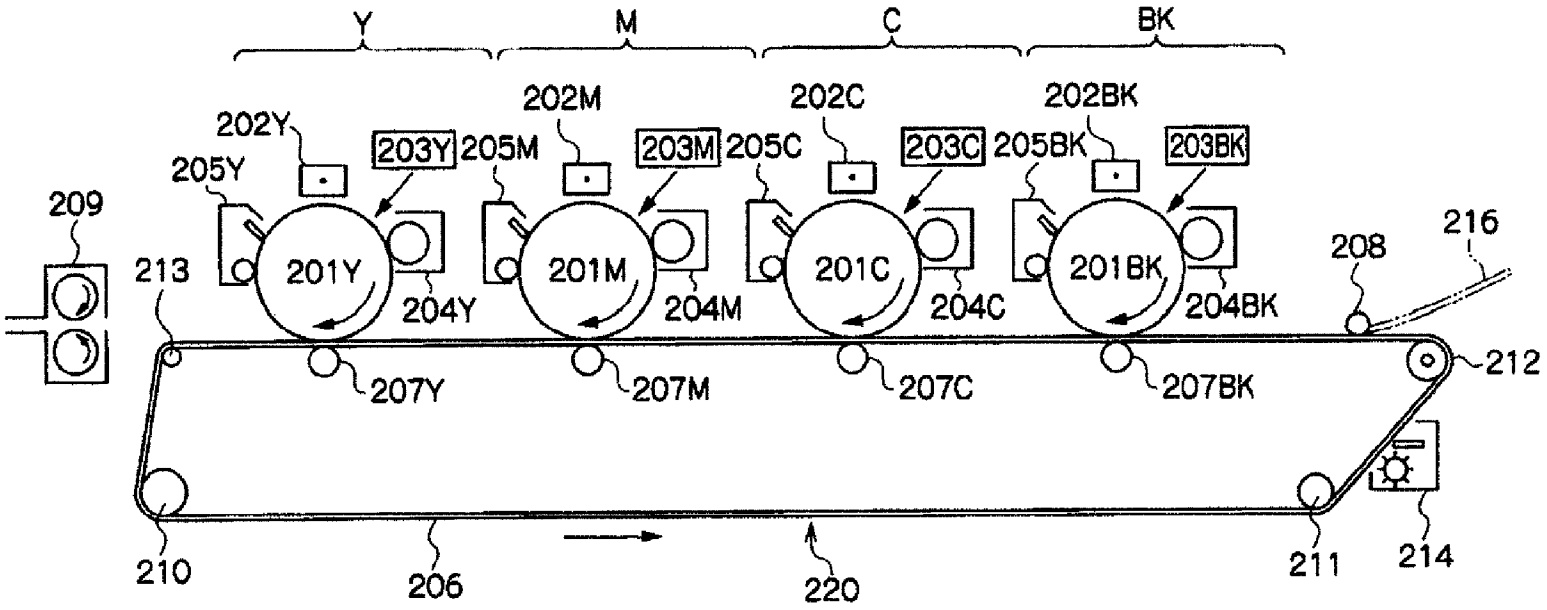
FIG. 2 is a schematic configuration diagram showing another example of the image forming apparatus according to the exemplary embodiment.

FIG. 2 is a schematic configuration diagram showing another example of the image forming apparatus according to the exemplary embodiment. The image forming apparatus shown in FIG. 2 is an image forming apparatus in which the endless belt according to the exemplary embodiment is applied as a recording medium transport member (paper transport belt).

In the image forming apparatus shown in FIG. 2, units Y, M, C, and BK respectively include photoreceptor drums 201Y, 201M, 201C, and 201BK that may rotate clockwise in the arrow direction. Around the photoreceptor drums 201Y, 201M, 201C, and 201BK, charging members 202Y, 202M, 202C, and 202BK, exposure units 203Y, 203M, 203C, and 203BK, developing devices for each color (a yellow developing device 204Y, a magenta developing device 204M, a cyan developing device 204C, and a black developing device 204BK), and photoreceptor drum cleaning members 205Y, 205M, 205C, and 205BK are disposed respectively.

The units Y, M, C, and BK are disposed in the order of the units BK, C, M, and Y in parallel with the paper transport belt 206. However, any proper order conforming to the image formation method such as the order of the units BK, Y, C, and M may be set.

The paper transport belt 206 is supported by belt support rolls 210, 211, 212, and 213 while receiving tension from the inner surface side thereof to form an endless belt unit 220. The paper transport belt 206 may rotate at the same circumferential speed as the photoreceptor drums 201Y, 201M, 201C, and 201BK counterclockwise in the arrow direction and is disposed such that a part of the paper transport belt positioned between the belt support rolls 212 and 213 comes in contact with the photoreceptor drums 201Y, 201M, 201C, and 201BK respectively. The paper transport belt 206 includes a belt cleaning member 214.

The transfer rolls 207Y, 207M, 207C, and 207BK are respectively disposed on the inside of the paper transport belt 206 and at the positions facing the portions where the paper transport belt 206 and the photoreceptor drums 201Y, 201M, 201C, and 201BK are in contact with each other, and the transfer rolls and the photoreceptor drums 201Y, 201M, 201C, and 201BK form transfer areas for transferring each toner image to paper (transfer medium) 216 with the paper transport belt 206 therebetween. The transfer rolls 207Y, 207M, 207C, and 207BK may be disposed just below the photoreceptor drums 201Y, 201M, 201C, and 201BK as shown in FIG. 2 or may be disposed at positions deviating from the positions just below the photoreceptor drums.

The fixing device 209 is disposed so that the paper is transported after passing through the respective transfer areas between the paper transport belt 206 and the photoreceptor drums 201Y, 201M, 201C, and 201BK.

The paper 216 is transported on the transport belt 206 by the paper feed roll 208.

In the image forming apparatus shown in FIG. 2, the photoreceptor drum 201BK is rotationally driven in the unit BK. The charging member 202BK is driven in operative association with rotation of the photoreceptor drum, and charges the surface of the photoreceptor drum 201BK at a target polarity and potential. The photoreceptor drum 201BK having the surface charged is then imagewisely exposed by the exposure unit 203BK and an electrostatic charge image is formed on the surface thereof.

Subsequently, the electrostatic charge image is developed by the black developing device 204BK. Then, a toner image is formed on the surface of the photoreceptor drum 201BK. The toner at this time may be mono component toner or may be dual-component toner.

The toner image passes through the transfer area between the photoreceptor drum 201BK and the paper transport belt 206 and the paper 216 is electrostatically attracted to the paper transport belt 206 and is transported to the transfer area. The toner image is sequentially transferred to the surface of the paper 216 according to an electric field formed by a transfer bias applied from the transfer roll 207BK.

Then, the toner remaining on the photoreceptor drum 201BK is cleaned and removed by the photoreceptor drum cleaning member 205BK. The photoreceptor drum 201BK is provided for the next image transfer.

The above image transfer is also carried out in the above-described manner in the units C, M and Y.

The paper 216 to which the toner images are transferred by the transfer rolls 207BK, 207C, 207M, and 207Y is further transported to the fixing device 209 and the toner images are fixed.

In the above manner, a desired image is formed on the paper.

Next, an image forming apparatus in which the endless belt according to the exemplary embodiment is used as a fixing belt (heating belt or pressure belt) will be described.

As the image forming apparatus in which the endless belt according to the exemplary embodiment is used as a fixing belt (heating belt or pressure belt), for example, an image forming apparatus which is the same as the image forming apparatus shown in FIG. 1 or 2 may be used. In the image forming apparatus shown in FIG. 1 or 2, as the fixing device 110 or the fixing device 209, for example, a fixing device using the endless belt according to the exemplary embodiment, which will be described later, is applied.

Hereinafter, the fixing device in which the endless belt according to the exemplary embodiment is used as a fixing belt (heating belt or pressure belt) will be described.

Fixing Device

The fixing device according to the exemplary embodiment has various configurations and for example, the fixing device includes a first rotary member, and a second rotary member that is in contact with the outer surface of the first rotary member. The fixing member according to the exemplary embodiment is applied as at least one of the first rotary member and the second rotary member.

Hereinafter, as first and second exemplary embodiments of the fixing device, fixing devices including a heating belt and a pressure roll will be described.

The fixing device is not limited to the first and second exemplary embodiments and a fixing device including a heating roll or a heating belt and a pressure belt may be used. Then, the endless belt according to the exemplary embodiment may be applied to the heating belt or the pressure belt.

In addition, the fixing device is not limited to the first and second exemplary embodiments and an electromagnetic induction heating type fixing device may be used.

First Exemplary Embodiment of Fixing Device

Figure 3:
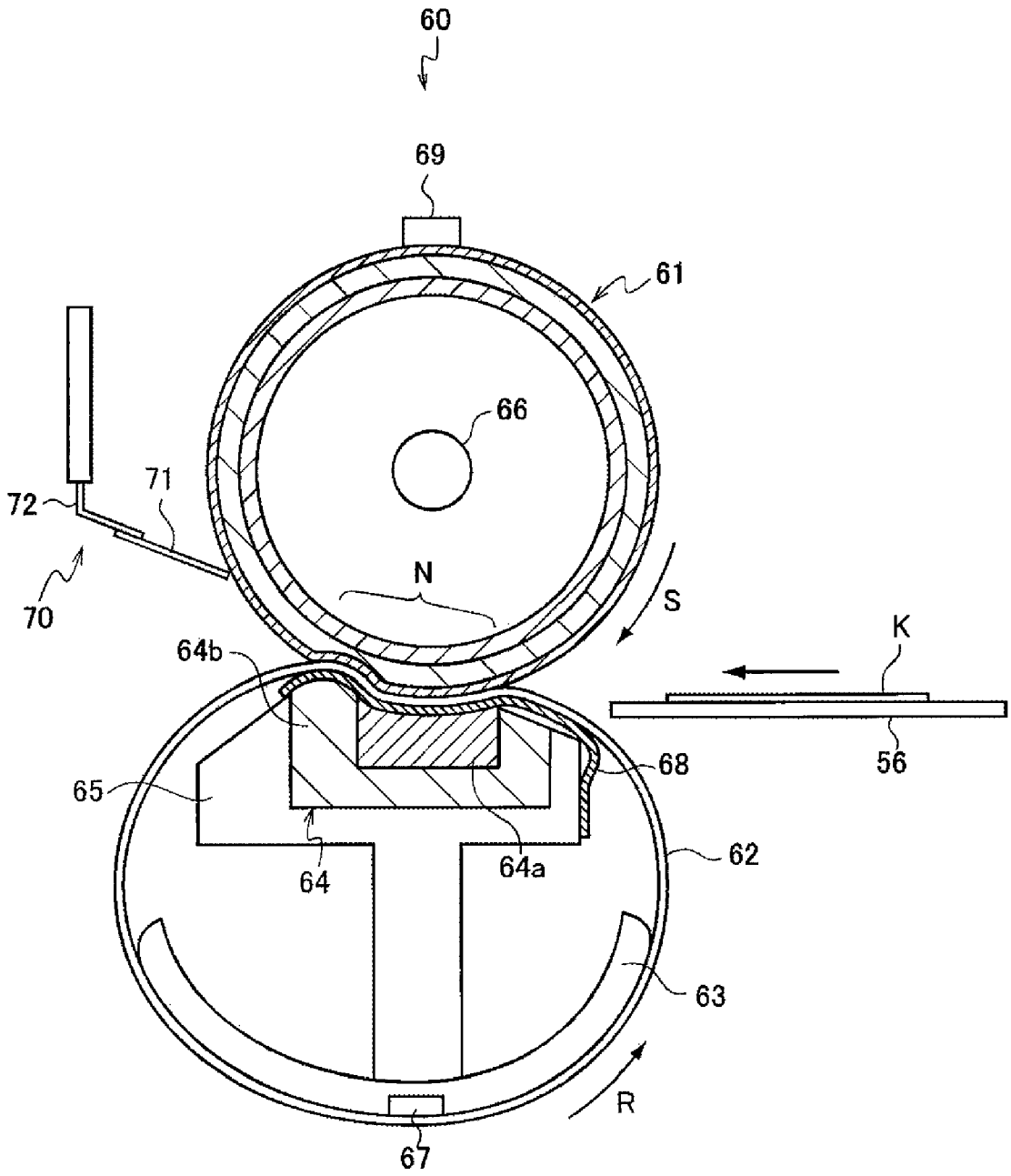
FIG. 3 is a schematic configuration diagram showing an example of a fixing device according to a first exemplary embodiment.

The fixing device according to the first exemplary embodiment will be described. FIG. 3 is a schematic diagram showing an example of a fixing device according to the first exemplary embodiment.

As shown in FIG. 3, for example, a fixing device 60 according to the first exemplary embodiment is configured to include a heating roll 61 which is rotationally driven (an example of the first rotary member), a pressure belt 62 (an example of the second rotary member), and a pressing pad 64 (an example of a pressing member) which presses the heating roll 61 with the pressure belt 62.

The pressing pad 64 is only has to make, for example, the pressure belt 62 and the heating roll 61 be pressed against each other. Accordingly, the pressure belt 62 may be pressed against the heating roll 61 or the heating roll 61 may be pressed against the pressure belt 62.

A halogen lamp 66 (an example of a heating unit) is disposed in the heating roll 61. The heating unit is not limited to the halogen lamp and other heating members that generate heat may be used.

On the other hand, for example, a temperature sensing element 69 is disposed on the surface of the heating roll 61 so as to come into contact with the surface of the heating roll. The lighting of the halogen lamp 66 is controlled according to a temperature value measured by the temperature sensing element 69, so that the surface temperature of the heating roll is maintained at a predetermined set temperature (for example, 150° C.)

The pressure belt 62 is rotatably supported by, for example, the pressing pad 64 and a belt travel guide 63 that are disposed in the pressure belt. Further, the pressure belt is disposed so as to be pressed against the heating roll 61 in a nip area N (nip portion) by the pressing pad 64.

The pressing pad 64 is disposed, for example, on the inside of the pressure belt 62 in a state in which the pressing pad is pressed against the heating roll 61 with the pressure belt 62, and forms the nip area N between the pressing pad and the heating roll 61.

The pressing pad 64 includes, for example, a front nip member 64*a* that secures a wide nip area N and is disposed on the inlet side of the nip area N, and a release-nip member 64*b* that applies a strain to the heating roll 61 and is disposed on the outlet side of the nip area N.

In order to reduce the sliding resistance between the inner circumferential surface of the pressure belt 62 and the pressing pad 64, for example, a sheet-shaped sliding member 68 is provided on the surfaces of the front nip member 64*a* and the release-nip member 64*b*, which come into contact with the pressure belt 62. Further, the pressing pad 64 and the sliding member 68 are held by a holding member 65, 67 made of metal.

The sliding member 68 is provided such that, for example, the sliding surface of the sliding member comes into contact with the inner circumferential surface of the pressure belt 62. Thus, the sliding member is involved in the holding and supply of oil that is present between the pressure belt 62 and the sliding member 68.

The belt travel guide 63 is mounted on the holding member 65, 67 so that the pressure belt 62 is rotated.

The heating roll 61 rotates in the direction of an arrow S by, for example, a driving motor (not shown), and the pressure belt 62 rotates in the direction of an arrow R opposite to the rotational direction of the heating roll 61, by the rotation of the heating roll. That is, for example, the heating roll 61 rotates in the clockwise direction in FIG. 3 and the pressure belt 62 rotates in the counterclockwise direction.

Paper K (an example of the recording medium) having an unfixed toner image is guided by, for example, a fixing inlet guide 56 and transported to the nip area N. When the paper K passes through the nip area N, the toner image formed on the paper K is fixed by pressure and heat that are applied to the nip area N.

In the fixing device 60 according to the first exemplary embodiment, for example, a wide nip area N, which is larger than the nip area of a structure without the front nip member 64*a*, is secured by the front nip member 64*a* that has a concave shape corresponding to the outer circumferential surface of the heating roll 61.

In addition, in the fixing device 60 according to the first exemplary embodiment, for example, the release-nip member 64*b* is disposed so as to protrude from the outer circumferential surface of the heating roll 61, so that the strain of the heating roll 61 in the outlet area of the nip area N is locally increased.

When the release-nip member 64*b* is disposed as described above, the paper K to which the toner image has been fixed passes through the locally increased strain, for example, when passing through a release-nip area. Thus, the paper K is easily released from the heating roll 61.

A release member 70 is provided as an auxiliary release unit, for example, on the downstream side of the nip area N of the heating roll 61. The release member 70 includes a peeling claw 71 that is held by a holding member 72, for example, in a state of being close to the heating roll 61 while facing the heating roll 61 in the direction opposite to the rotational direction of the heating roll 61 (counter direction).

Second Exemplary Embodiment of Fixing Device

Figure 4:
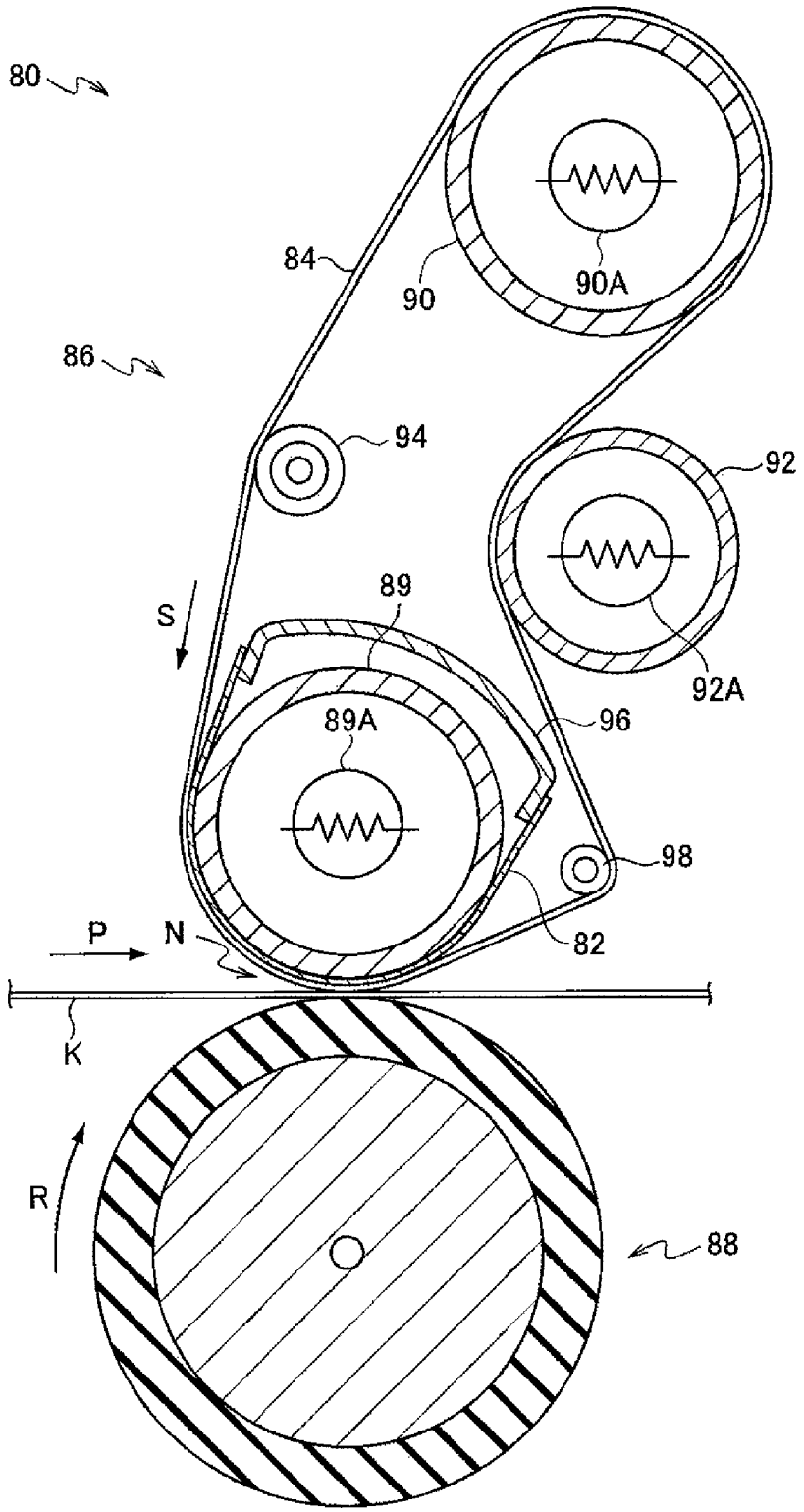
FIG. 4 is a schematic configuration diagram showing an example of a fixing device according to a second exemplary embodiment.

The fixing device according to the second exemplary embodiment will be described. FIG. 4 is a schematic diagram showing an example of a fixing device according to the second exemplary embodiment.

As shown in FIG. 4, a fixing device 80 according to the second exemplary embodiment is configured to include a fixing belt module 86 including a heating belt 84 (an example of the first rotary member), and a pressure roll 88 (an example of the second rotary member) that is disposed so as to be pressed against the heating belt 84 (fixing belt module 86). Further, for example, a nip area N (nip portion), where the heating belt 84 (fixing belt module 86) and the pressure roll 88 come into contact with each other, is formed. Paper K (as an example of the recording medium) is pressed and heated at the nip area N, so that a toner image is fixed.

The fixing belt module 86 includes, for example, an endless heating belt 84, a heating-pressing roll 89 around which the heating belt 84 is wound on the side close to the pressure roll 88 and which is rotationally driven by the torque of a motor (not shown) and pushes the heating belt 84 toward the pressure roll 88 from the inner circumferential surface of the heating belt, and a support roll 90 that supports the heating belt 84 from the inside at a position different from the position of the heating-pressing roll 89.

The fixing belt module 86 is provided with; for example, a support roll 92 that is disposed on the outside of the heating belt 84 and defines the circulating path of the heating belt; a posture correcting roll 94 that corrects the posture of the heating belt 84 between the heating-pressing roll 89 and the support roll 90; and a support roll 98 that applies tension to the heating belt 84 from the inner circumferential surface of the heating belt 84 on the downstream side of the nip area N, which is an area where the heating belt 84 (fixing belt module 86) and the pressure roll 88 come into contact with each other.

The fixing belt module 86 is provided so that the sheet-shaped sliding member 82 is interposed, for example, between the heating belt 84 and the heating-pressing roll 89.

The sliding member 82 is provided such that, for example, the sliding surface of the sliding member comes into contact with the inner surface of the heating belt 84. Accordingly, the sliding member 82 is involved in the holding and supply of oil that is present between the heating belt 84 and the sliding member 82.

Here, the sliding member 82 is provided, for example, in a state in which the both ends of the sliding member are supported by the supporting member 96.

A halogen heater 89A (an example of a heating unit) is provided in the heating-pressing roll 89.

The support roll 90 is a cylindrical roll that is made of, for example, aluminum, and the halogen heater 90A (an example of the heating unit) is provided on the inside of the support roll 90 so as to heat the heating belt 84 from the inner circumferential surface side of the heating belt.

In the both end portions of the support roll 90, for example, spring members (not shown), which press the heating belt 84 to the outside, are provided.

The support roll 92 is a cylindrical roll that is made of, for example, aluminum, and a release layer, which is formed of a fluorine resin and has a thickness of 20 μm, is formed on the surface of the support roll 92.

The release layer of the support roll 92 is formed, for example, to prevent toner or paper powder from being deposited on the support roll 92 from the outer circumferential surface side of the heating belt 84.

For example, a halogen heater 92A (an example of the heating unit) is provided in the support roll 92 so as to heat the heating belt 84 from the outer circumferential surface of the heating belt.

That is, for example, the heating belt 84 is heated by, for example, the heating-pressing roll 89, the support roll 90, and the support roll 92.

The posture correcting roll 94 is a cylindrical roll that is made of, for example, aluminum, and an end portion position measuring mechanism (not shown), which measures the position of the end portion of the heating belt 84, is disposed near the posture correcting roll 94.

The posture correcting roll 94 is provided with, for example, an axial displacement mechanism (not shown) that displaces the contact position of the heating belt 84 in an axial direction according to the measurement result of the end portion position measuring mechanism so as to control the meandering of the heating belt 84.

On the other hand, the pressure roll 88 is rotatably supported, and is disposed so as to be pressed against a portion of the heating belt 84, which is wound around the heating-pressing roll 89, by an urging member such as a spring (not shown). Accordingly, as the heating belt 84 of the fixing belt module 86 (heating-pressing roll 89) rotates in the direction of an arrow S, the pressure roll 88 is rotated in the direction of an arrow R by the heating belt 84 (heating-pressing roll 89).

Further, paper K having an unfixed toner image (not shown) is transported in the direction of an arrow P and guided to the nip area N of the fixing device 80, and the toner image is fixed by pressure and heat that are applied to the nip area N.

In the fixing device 80 according to the second exemplary embodiment, an exemplary embodiment in which a halogen heater (halogen lamp) is applied as an example of a heating source has been described but there is no limitation thereto. In addition to the halogen heater, a radiating lamp heat generating member (a heat generating member that emits radiation rays (such as infrared rays)), and a resistance heat generating member (a heat generating member that generates Joule heat by allowing a current to flow through a resistor: for example, a heat generating member obtained by forming a film having thick film resistance on a ceramic substrate and sintering the film) may be applied.

Endless Belt Unit

Examples of the endless belt unit according to an exemplary embodiment include an endless belt unit including the endless belt according to the exemplary embodiment and plural rolls which the endless belt is stretched over in a state where tension is applied.

The endless belt unit according to the exemplary embodiment includes, for example, a cylindrical member, and plural rollers over which the cylindrical member is stretched in a state in which tension is applied, as in the endless belt unit 107*b* shown in FIG. 1, and an endless belt unit 220 shown in FIG. 2.

Figure 5:
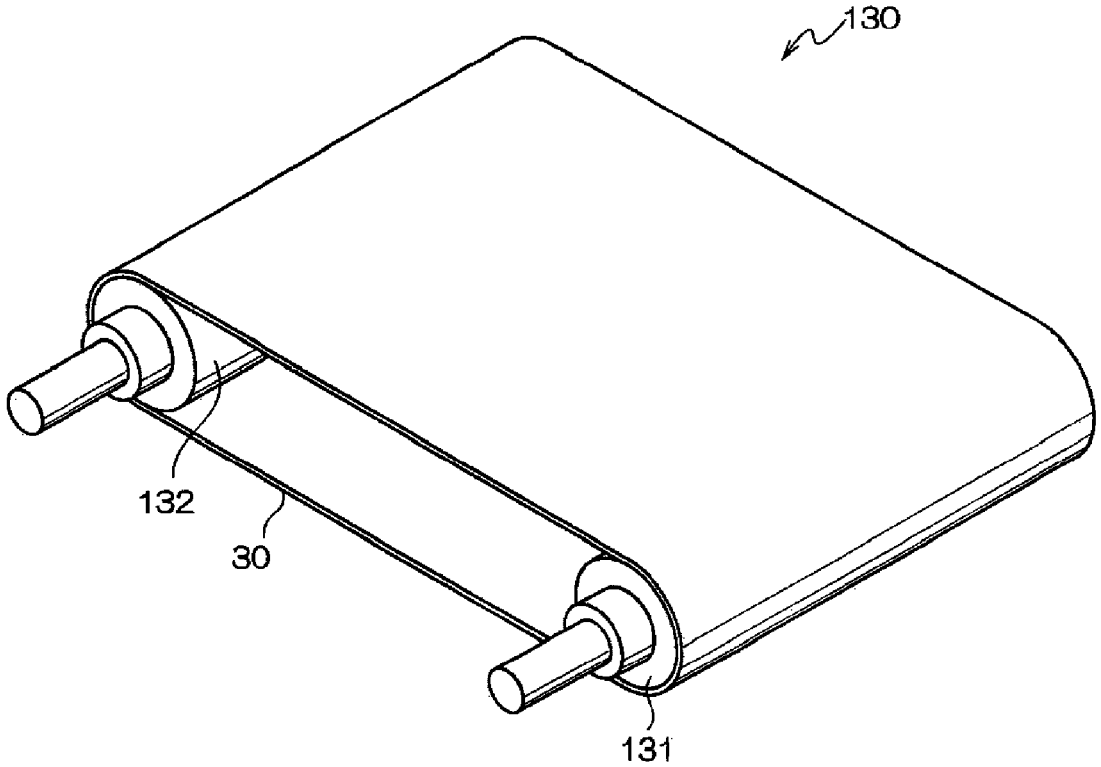
FIG. 5 is a schematic perspective diagram showing an example of an endless belt unit according to an exemplary embodiment.

For example, as an example of the endless belt unit according to the exemplary embodiment, an endless belt unit shown in FIG. 5 may be used.

FIG. 5 is a schematic perspective diagram showing an example of an endless belt unit according to the exemplary embodiment.

As shown in FIG. 5, an endless belt unit 130 according to the exemplary embodiment includes the endless belt 30 according to the exemplary embodiment, and for example, the endless belt 30 is stretched in a state in which tension is applied by a driving roll 131 and a driven roll 132 that are disposed to face each other.

Here, in the endless belt unit 130 according to the exemplary embodiment, in the case of applying the endless belt 30 as an intermediate transfer member, as rolls that support the endless belt 30, a roll for primarily transporting a toner image on the surface of a photoreceptor (image holding member) to the endless belt 30, and a roll for further secondarily transporting the toner image which has been transported on the endless belt 30 to a recording medium may be disposed.

The number of rolls that support the endless belt 30 is not limited and the rolls may be disposed according to the purpose of use. The endless belt unit 130 having the above configuration is used in a state in which the endless belt unit is incorporated and is rotated by the rotation of the driving roll 131 and the driven roll 132 in a state in which the endless belt 30 is supported.

EXAMPLES

Hereinafter, examples will be described. However, the invention is not limited to these examples. In the following description, unless otherwise specified, "part (s)" and "%" are based on weight.

Example 1

Preparation of Polyimide Precursor Composition (A-1)

200 g of tetramethyl urea (TMU) is placed in a flask equipped with a stirring rod, a thermometer, and a dropping funnel. Here, 20.02 g of 4,4'-diaminodiphenyl ether (ODA) is added thereto and the material is dispersed by stirring at 20° for 10 minutes. To the solution, 21.38 g of pyromellitic dianhydride (PMDA) is added, and while the reaction temperature is being maintained at 40° C., the material is dissolved by stirring for 24 hours to conduct reaction. Thus, a polyimide precursor composition (A-1) including a polyimide precursor A-1 is obtained.

Film Formation

Carbon black (SPECIAL BLACK 4, manufactured by Orion Engineered Carbons Co., Ltd.) is added to the polyimide precursor composition (A-1) such that the amount thereof is 4% by weight with respect to the polyimide precursor A-1 included in the polyimide precursor composition (A-1) based on the solid content weight ratio, and a dispersion treatment (200 N/mm$^2$ and 5 passes) is carried out with a jet mill disperser (Geanus PY, manufactured by Genus Co., Ltd). Thus, a carbon black dispersed polyimide precursor composition is obtained.

The obtained carbon black dispersed polyimide precursor composition is allowed to pass through a 20 μm mesh made of stainless steel to remove foreign substances and carbon black aggregates. Further, vacuum defoaming is carried out for 15 minutes while stirring and an endless belt forming coating liquid is prepared.

The prepared endless belt forming coating liquid is applied to the outer surface of a cylindrical metal mold (substrate) made of aluminum and the metal mold is rotated and dried at 150° C. for 30 minutes. Next, the metal mold is dried for 1 hour while rotating the metal mold at 20 rpm in an oven at 325° C. Then, the metal mold is taken out from the oven. A polyimide resin molded article formed on the outer surface of the metal mold is peeled off from the metal mold to obtain an endless belt having a polyimide resin layer with a thickness of 0.08 mm.

Measurement of Amount of Residual Solvent

As a result of measuring the amount (content) of the residual solvent with GC-MS according to the above-described method, the amount of the residual solvent is 400 ppm (based on weight).

Storage Test

Figure 6:
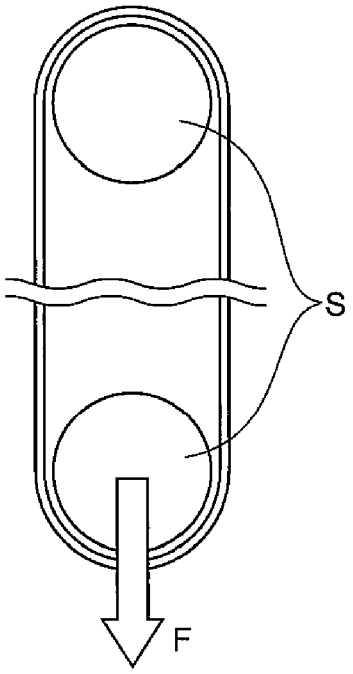
FIG. 6 is a schematic diagram illustrating a storage test for an endless belt in Examples.

Two shafts S having a diameter of 5 mm are attached to the inner side of the obtained endless belt and in a state in which one shaft is suspended by applying a load F of 5 kg, under the conditions of 60° C. and 90% RH, the endless belt is kept to stand for one week to conduct a storage test. Thereafter, the two shafts are removed and under the conditions of 23° C. and 50% RH, the endless belt is kept to stand for 1 hour and 24 hours. Then, the appearance of the endless belt is visually observed (refer to FIG. 6).

Evaluation Criteria

A: A change in shape is hardly observed even after the endless belt is kept to stand for 1 hour and 24 hours.

B: A partial (50% or less) change in shape is observed in the portions which have been in contact with the shafts after the endless belt is kept to stand for 1 hour but a change in shape is hardly observed after the endless belt is kept to stand for 24 hours.

C: A partial (50% or less) change in shape is observed in the portions which have been in contact with the shafts even after the endless belt is kept to stand for 24 hours.

D: A change in the entire shape is observed in the portions which have been in contact with the shafts even after the endless belt is kept to stand for 24 hours.

Cleaning Property Test

The obtained endless belt is mounted on an Apeos Port-III C4400 manufactured by Fuji Xerox Co., Ltd. An untransfered image with 100% image density is formed on two sheets of A3 paper in the longitudinal direction and then the toner remaining on the endless belt without being cleaned is collected with a tape. The evaluation on cleaning properties is carried out through visual observation.

Evaluation Criteria

A: Even one streak is not confirmed through in visual observation.

B: One to five streaks are confirmed in visual observation.

C: Six or more streaks are confirmed in visual observation.

Print Test

In the same manner as in the cleaning test, the obtained endless belt is mounted on an Apeos Port-III C4400 manufactured by Fuji Xerox Co., Ltd., and a print test is carried out at 30° C. and 80% RH.

Evaluation Criteria

In the axial direction of the portions which have been in contact with the shafts in the storage test, A: No blurring is observed in the image.

B: Slight blurring is observed in an area less than 5% of the image.

C: Blurring is observed in an area of 5% to less than 50% of the image.

D: Blurring is observed in an area of 50% or more of the image.

Examples 2 to 12 and Comparative Examples 1 to 4

Polyimide precursor compositions and endless belts are prepared and each of the evaluations is carried out in the same manner as in Example 1 except that the type of solvent is changed and the content of the solvent is adjusted to the amount shown in Table 1.

TABLE 1

| | Solvent | | Polyimide | Visual shape | Print Evaluation | | Cleaning | Total |
|---|---|---|---|---|---|---|---|---|
| | Type | Content (ppm) | precursor No. | observation after storage | Characters | 5% Halftone | Evaluation | evaluation |
| Example 1 | TMU | 400 | A-1 | B | A | A | B | B |
| Example 2 | TEU | 350 | A-2 | A | A | A | A | A |
| Example 3 | DMI | 300 | A-3 | A | A | A | A | A |
| Example 4 | DMI | 1000 | A-4 | A | A | A | A | A |
| Example 5 | DMPU | 1000 | A-5 | B | A | A | B | B |
| Example 6 | B-4 | 800 | A-6 | A | A | A | A | A |
| Example 7 | B-7 | 1000 | A-7 | B | A | A | B | B |
| Example 8 | C-3 | 1100 | A-8 | A | A | A | A | A |
| Example 9 | TEU | 70 | A-9 | B | A | A | B | B |
| Example 10 | TEU | 1800 | A-10 | B | B | B | B | C |
| Example 11 | DMI | 55 | A-11 | B | A | A | B | B |
| Example 12 | DMI | 1900 | A-12 | B | A | A | B | B |
| Comparative Example 1 | TMU | 45 | a-1 | C | B | B | C | D |
| Comparative Example 2 | TMU | 2100 | a-2 | C | B | B | C | D |
| Comparative Example 3 | GBL | 700 | a-3 | D | C | B | C | D |
| Comparative Example 4 | NMP | 700 | a-4 | C | B | C | C | D |

Example 13

Preparation of Polyimide Precursor Composition (B-13)

200 g of tetramethyl urea (TMU) is placed in a flask equipped with a stirring rod, a thermometer, and a dropping funnel. Here, 10.81 g of p-phenylenediamine (PDA) is added thereto and the material is dispersed by stirring at 20° C. for minutes. To the solution, 28.83 g of 3,3',4,4'-biphenyltetracarboxylic dianhydride (BPDA) is added, and while the reaction temperature is being maintained at 20° C., the material is dissolved by stirring for 24 hours to conduct reaction. Thus, a polyimide precursor composition (B-13) including a polyimide precursor B-13 is obtained.

Film Formation

The surface of a cylindrical metal mold (substrate) made of aluminum is roughened by a blast treatment and further a silicone release agent (trade name: KS-700, manufactured by Shin-Etsu Chemical Co., Ltd.) is applied to the outer circumferential surface of the metal mold, followed by a baking treatment at 300° C. for 1 hour. Thus, a metal mold having a surface having a surface roughness Ra of 0.8 μm and with the baked silicone release agent thereon is prepared. Next, the polyimide precursor composition (B-1) whose viscosity is adjusted to 120 Pa·s is applied to 470 mm of the center portion of the prepared metal mold by a flow coating (spiral coating) method. Next, the coating liquid is dried while rotating the metal mold at 100° C. for 50 minutes. Thus, a smoothened polyimide precursor coating film is obtained.

Next, a solution obtained by blending carbon black (KETJENBLACK dispersion solution, manufactured by Lion Corporation) with a fluororesin (PFA) dispersion solution (trade name: 710CL, manufactured by DuPont-Mitsui fluorochemicals Company, Ltd.) such that the ratio in the solid content is 2% by weight is applied to the coating film of the polyimide precursor by a spraying method. Then, the temperature is raised to 380° C. for 150 minutes while rotating the metal mold at 30 rpm, and then the temperature is held at 380° C. for 40 minutes to sinter the coating film. Next, the coating film (film) is cooled at room temperature (25° C.) and then detached from the metal mold to obtain an endless belt having a polyimide resin layer in which a PFA layer having a film thickness of 30 μm is formed on the outer circumferential surface of the polyimide resin molded article having a film thickness of 70 μm.

Measurement of Amount of Residual Solvent

As a result of measuring the amount (content) of the residual solvent with GC-MS according to the above-described method, the amount of the residual solvent is 500 ppm (based on weight).

Storage Test

A storage test is carried out in the same manner as in Example 1.

Paper Transportability Test

Figure 7:
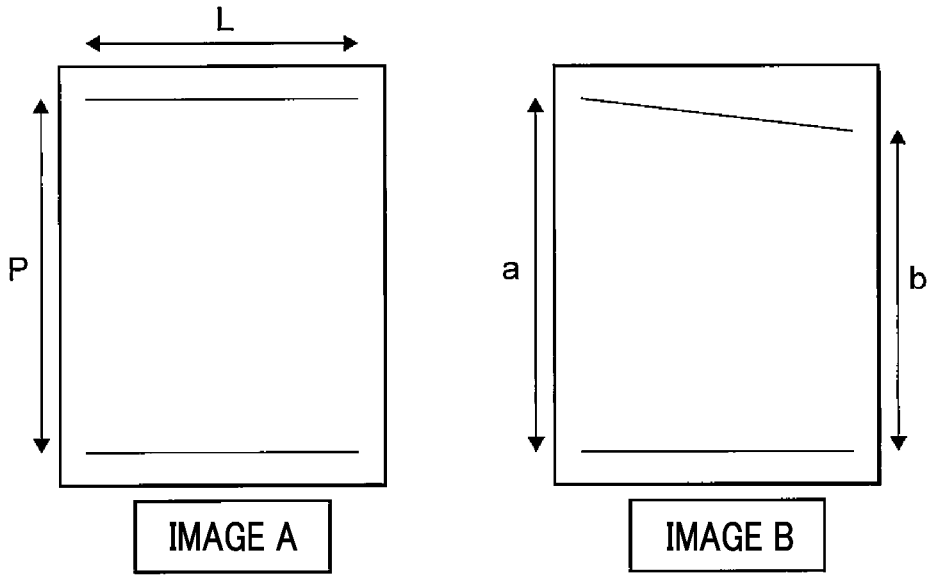
FIG. 7 is a schematic diagram illustrating a paper transportability test for an endless belt in Examples.

The obtained endless belt is mounted on an Apeos Port-III C4400 manufactured by Fuji Xerox Co., Ltd. In an environment at 10° C. and 40% RH, an image A in which two one-dot lines are formed with a pitch P of 370 mm in the longitudinal direction of A3 paper and a length L of 250 mm in a transverse direction is output to A3 paper in the longitudinal direction. After the image is output, in an image B, the maximum value a of the pitch of two one-dot lines and the minimum value b of the pitch of two one-dot lines are measured to calculate a difference between a and b. Based on the following evaluation criteria, the paper transportability is evaluated (refer to FIG. 7).

Evaluation Criteria

A: a and b are in a range of 370±0.5 mm and a difference between a and b is less than 1 mm.

B: A difference between a and b is less than 1 mm.

C: A difference between a and b is 1 mm or more and less than 1.5 mm.

D: A difference between a and b is 1.5 mm or more.

Print Test

In the same manner as in the cleaning test, the obtained endless belt is mounted on an Apeos Port-III C4400 manufactured by Fuji Xerox Co., Ltd., and a print test is carried out at 10° C. and 40% RH.

Evaluation Criteria

In the axial direction of the portions which have been in contact with the shafts in the storage test, A: No image blurring is observed.

B: Slight image blurring is observed in an area less than 5%.

C: Image blurring is observed in an area of 5% to less than 10%.

D: Image blurring is observed in an area of 10% or more.

Examples 14 to 24 and Comparative Examples 5 to 8

Polyimide precursor compositions and endless belts are prepared and each of the evaluations is carried out in the same manner as in Example 13 except that the type of solvent is changed and the content of the solvent is adjusted to the amount shown in Table 2.

TABLE 2

| | Solvent | | Polyimide | Visual shape | Print Evaluation | | Paper transport- | |
|---|---|---|---|---|---|---|---|---|
| | Type | Content (ppm) | precursor No. | observation after storage | Characters | 5% Halftone | ability evaluation | Total evaluation |
| Example 13 | TMU | 500 | B-13 | B | A | A | B | B |
| Example 14 | TEU | 600 | B-14 | A | A | A | A | A |
| Example 15 | DMI | 550 | B-15 | A | A | A | A | A |
| Example 16 | DMI | 850 | B-16 | A | A | A | A | A |
| Example 17 | DMPU | 700 | B-17 | B | A | A | B | B |
| Example 18 | B-4 | 400 | B-18 | A | A | A | A | A |
| Example 19 | B-7 | 650 | B-19 | A | A | A | A | A |
| Example 20 | C-3 | 500 | B-20 | B | A | A | B | B |
| Example 21 | B-4 | 75 | B-21 | B | A | A | B | B |
| Example 22 | B-4 | 1850 | B-22 | B | A | A | B | B |
| Example 23 | DMI | 70 | B-23 | A | A | A | A | A |
| Example 24 | DMI | 1900 | B-24 | B | A | A | B | B |

TABLE 2-continued

| | Solvent | | Polyimide | Visual shape | Print Evaluation | | Paper transport- | |
|---|---|---|---|---|---|---|---|---|
| | Type | Content (ppm) | precursor No. | observation after storage | Characters | 5% Halftone | ability evaluation | Total evaluation |
| Comparative Example 5 | TMU | 44 | b-1 | C | B | B | C | D |
| Comparative Example 6 | TMU | 2050 | b-2 | C | C | B | C | D |
| Comparative Example 7 | GBL | 700 | b-3 | C | C | C | C | D |
| Comparative Example 8 | NMP | 750 | b-4 | C | B | C | C | D |

The abbreviations in Tables 1 to 2 are as follows.

TMU: Tetramethyl urea

TEU: Tetraethyl urea

DMPU: N,N'-dimethylpropylene urea

DMI: 1,3-dimethyl-2-imidazolidinone

B-4: Exemplified compound B-4 (3-methoxy-N,N-dimethylpropanamide)

B-7: Exemplified compound B-7 (3-n-butoxy-N,N-dimethylpropanamide)

C-3: Exemplified compound C-3 (5-dimethylamino-2-ethyl-5-oxo-methylpentanoate)

GBL: γ-butyrolactone

NMP: N-methylpyrrolidone

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An endless belt comprising:

a polyimide resin layer in which a content of at least one solvent selected from a solvent group A consisting of a urea solvent, an alkoxy group-containing amide solvent, and an ester group-containing amide solvent is from 50 ppm to 2,000 ppm.

2. The endless belt according to claim 1, wherein a content of at least one solvent selected from the solvent group A is from 70 ppm to 1,500 ppm.

3. The endless belt according to claim 1, wherein a content of at least one solvent selected from the solvent group A is from 100 ppm to 1,000 ppm.

4. The endless belt according to claim 1, wherein a boiling point of at least one solvent selected from the solvent group A is from 100° C. to 350° C.

5. The endless belt according to claim 4, wherein the solvent of the solvent group A is 1,3-dimethyl-2-imidazolidinone.

6. The endless belt according to claim 4, wherein the polyimide resin layer further contains conductive particles.

7. The endless belt according to claim 1, wherein the solvent group A is a solvent group consisting of tetramethyl urea, tetraethyl urea, 1,3-dimethyl-2-imidazolidinone, N,N'-dimethylpropylene urea, 3-methoxy-N,N-dimethylpropanamide, and 3-n-butoxy-N,N-dimethylpropanamide.

8. The endless belt according to claim 7, wherein the solvent of the solvent group A is 1,3-dimethyl-2-imidazolidinone.

9. The endless belt according to claim 7, wherein the polyimide resin layer further contains conductive particles.

10. The endless belt according to claim 1, wherein the solvent of the solvent group A is 1,3-dimethyl-2-imidazolidinone.

11. The endless belt according to claim 10, wherein the polyimide resin layer further contains conductive particles.

12. The endless belt according to claim 1, wherein the polyimide resin layer further contains conductive particles.

13. An image forming apparatus comprising:

the endless belt according to claim 1.

14. An endless belt unit comprising:

the endless belt according to claim 1; and a plurality of rolls which the endless belt is stretched over in a state where tension is applied.

* * * * *